US008541737B2

(12) United States Patent
Ibrahim et al.

(10) Patent No.: US 8,541,737 B2
(45) Date of Patent: Sep. 24, 2013

(54) SYSTEM AND METHOD FOR COLLISIONAL ACTIVATION OF CHARGED PARTICLES

(75) Inventors: Yehia M. Ibrahim, Richland, WA (US); Mikhail E. Belov, Richland, WA (US); David C. Prior, Hermiston, OR (US)

(73) Assignee: Battelle Memorial Institute, Richland, WA (US)

( * ) Notice: Subject to any disclaimer, the term of this patent is extended or adjusted under 35 U.S.C. 154(b) by 775 days.

(21) Appl. No.: 12/769,268

(22) Filed: Apr. 28, 2010

(65) Prior Publication Data

US 2011/0127417 A1 Jun. 2, 2011

Related U.S. Application Data

(60) Provisional application No. 61/265,278, filed on Nov. 30, 2009.

(51) Int. Cl.
*H01J 49/00* (2006.01)

(52) U.S. Cl.
USPC ..... 250/282; 250/281; 250/290; 250/291; 250/292; 250/293

(58) Field of Classification Search
USPC ..... 250/281, 282, 290–293
See application file for complete search history.

(56) References Cited

U.S. PATENT DOCUMENTS

| | | | | |
|---|---|---|---|---|
| 5,430,359 | A | 7/1995 | Swenson et al. | |
| 7,223,969 | B2 | 5/2007 | Schultz et al. | |
| 2005/0189486 | A1 * | 9/2005 | Fuhrer et al. | 250/287 |
| 2010/0252730 | A1 * | 10/2010 | Green et al. | 250/283 |

OTHER PUBLICATIONS

Yost, R. A. et al., High Efficiency Collision-Induced Dissociation in an RF-Only Quadrupole, International Journal of Mass Spectrometry and Ion Physics, 30, 1979, pp. 127-136.
Thomson, Bruce A., et al., Improved Collisionally Activated Dissociation Efficiency and Mass Resolution on a Triple Quadrupole Mass Spectrometer System, Anal. Chem., 67, 1995, pp. 1696-1704.
Guo, Yuzhu, et al., The High-Pressure Segmented Quadrupole Collision Cell (HP-SQCC) as an Ion Molecule Reactor, J. Am. Soc. Mass. Spectrom., 2005, 16, pp. 957-966.
Fernandez-Lima, Francisco A., et al., Ion Mobility-Mass Spectrometer Interface for Collisional Activation of Mobility Separated Ions, Anal. Chem., 2009, 81, pp. 681-624.
Becker, Christopher, et al., A Novel Approach to Collision-Induced Dissociation (CID) for Ion Mobility-Mass Spectrometry Experiments, J. Am. Soc. Mass Spectrom., 2009, 20, pp. 907-914.

* cited by examiner

*Primary Examiner* — Michael Maskell
(74) *Attorney, Agent, or Firm* — James D. Matheson

(57) ABSTRACT

A collision cell is disclosed that provides ion activation in various selective modes. Ion activation is performed inside selected segments of a segmented quadrupole that provides maximum optimum capture and collection of fragmentation products. The invention provides collisional cooling of precursor ions as well as product fragments and further allows effective transmission of ions through a high pressure interface into a coupled mass analysis instrument.

26 Claims, 11 Drawing Sheets

SYSTEM AND METHOD FOR COLLISIONAL ACTIVATION OF CHARGED PARTICLES

CROSS REFERENCE TO RELATED APPLICATION

This application claims priority from Provisional application No. 61/265,278 filed 30 Nov. 2009, which application is incorporated in its entirety herein.

STATEMENT REGARDING RIGHTS TO INVENTION MADE UNDER FEDERALLY-SPONSORED RESEARCH AND DEVELOPMENT

This invention was made with Government support under Contract DE-AC06-76RLO1830 awarded by the U.S. Department of Energy. The Government has certain rights in the invention.

BACKGROUND OF THE INVENTION

Identification of biomolecules is routine in biopharmaceutical and proteomics research. Current commercial mass spectrometers can be equipped with collision cells that employ quadrupoles or multipoles in which ion fragmentation occurs by a process known as collision-induced dissociation (CID). Conventional CID is a process in which ions are accelerated by an electric field to increase the ion kinetic energy. Upon collision with a buffer gas, the ions fragment. In these conventional devices, CID occurs at the entrance of the quadrupole, where ion scattering at the ends of the quadrupole rods and strength of the DC field gradient are the greatest. Fragmentation can also take place inside the quadrupole, but fragmentation efficiency strongly depends on the quadrupole pressure, as kinetic energy dampening due to collisions is significant while the electric field inside the quadrupole is zero. CID in conventional quadrupoles often suffers from poor fragmentation and poor collection efficiencies because of: 1) a relatively low operation pressure (typical pressures are 1-5 mTorr), 2) few collisions per unit length, 3) a low collision energy in the center-of-mass frame that limits activation of larger molecules, and 4) because fragment ions produced in RF-fringing fields at the quadrupole entrance can be easily lost due to scattering. For example, collection efficiencies for multiple-charged species in triple-quadrupole instruments have typical best values between 10% and 17%.

The primary purpose of RF fields in conventional devices is to radially confine ions. In some applications, RF fields can be used to cause ion instability that result in increased radial oscillations of precursor ions. In this case, all ions with an m/z below that of the precursor become unstable, meaning one can only detect fragments with an m/z above that of the precursor. For multiply-charged ions, this means that up to a full half of useful structural information can be lost in a mass spectrum. As a result, poor fragmentation patterns occur, and insufficient structural information is obtained to ascertain required sequencing information by which to unambiguously identify molecules of interest. If the internal energy content of the parent (primary precursor) ions is high, some fraction of the parent ions will gain sufficient energy to fragment further, producing secondary fragments from the primary fragments, which proves to be of little value for structural determination of complex ions. For example, in conventional devices, precursor ions typically dissociate in close proximity to the quadrupole entrance, resulting in fragment ions that impart additional activation energy further downstream in the quadrupole, which results in secondary fragments that provide little structural information or that gives rise to uninformative spectra. In addition, in conventional MS/MS, activation of singly-charged precursor ions requires higher electric, fields, which also results in secondary fragmentation of fragments produced by multiply-charged ions of the same species, which again provides little useful information for structural determination of ions. While conventional activation methodologies and devices provide some fragmentation data, ultimately, in excess of 25% of large bio-molecules including, e.g., proteins and peptides, are estimated to remain unidentified in conventional tandem MS/MS experiments using, e.g., conventional triple-quadrupole instruments. Triple-quadrupole instruments can fail to characterize and identify complex molecules due to an inability to provide sufficient structure-specific fragments for the molecules of interest. Accordingly, new systems and methods are needed that increase the fragmentation efficiencies necessary to producing an abundance of structurally-rich fragment ions by which to identify complex molecules.

SUMMARY OF THE INVENTION

The invention includes an IMS TOF-MS system and method for enhanced fragmentation of ions. The system is characterized by: an ion channel that defines an axis traversed by precursor ions in a buffer gas at a pressure greater than 20 mTorr, the collision dell having substantially orthogonal focusing RF-field and an axial DC-field along the axis; and a plurality of high-intensity, structurally-rich fragment ions inside the ion channel. The axial DC-field determines the collision energy of precursor ions interacting with a buffer gas in the RF-focusing field that provides radial confinement of both precursor and fragment ions, and also contributes to fragmentation of precursor ions, inside the ion channel. The ion channel it defined by a preselected number (N) of circumvolving elongate members including; but not limited to, e.g., rods, plates, and poles, where (N) is an even-numbered integer greater than or equal to 2. The elongate members each comprise at least two operably coupled linear segments that deliver a preselected potential of like or different kind. The linear segments are each insulated from another segment with a resistor chain or network that controls the axial DC-field applied to the elongate members. In another implementation, the axial, DC and radial RF fields are spatially decoupled, so that two 180° phase-shifted RF waveforms are applied to two pairs of solid rods, while an axial DC field is generated with a linear assembly of the segmented thin plates, or vanes, inserted between the rods in such a manner to remain on the zero RF potential line. Each vane assembly has the length of the collision cell. For a quadrupole, there are four sets of the segmented vane assemblies. To enable ion packet displacement in the radial direction, two adjacent sets of segmented vanes are coupled and biased with respect to the other two coupled sets, while the axial DC gradient is maintained, the same for all vane assemblies. The term "bias" means an applied potential with respect to an earth ground. The axial DC field is achieved by biasing segments with respect to each other in a single vane assembly. Radial displacement generated in the entrance region of the collision cell is removed in the exit region to ensure ion packet relaxation to the collision cell axis and efficient ion transmission to the downstream ion optics. The radial DC field can be constant or pulsed. Amplitudes of pulsed radial DC field voltages are preferably selected in the range from about 10 V (volts) to about 50 V (volts). Amplitudes of constant DC field voltages are preferably selected in the range from about 10 V to about 50 V. In One embodiment, the radial DC field is synchronized with an IMS gate to enable radial displacement of a species of interest previously separated in the drift tube IMS. In various embodiments, precursor ion activation in the collision cell is achieved by: i) an increased axial DC field alone (no radial displacement); ii) RF-heating due to radial displacement of ions with respect to the collision cell axis, with a minimum of ion activation due to the axial DC field; and iii) a combined RF-heating and axial DC-field. In another embodiment, the distribution of the radial DC field is symmetric about the ion channel axis. In yet another embodiment, the distribution of the radial DC field is asymmetric about the ion channel axis. In still yet another embodiment, a DC pulse generates a radial DC field that provides radial displacement of precursor ions from the axis inside the collision cell. Fragment ions are radially confined within the RF-focusing field. In another embodiment, the collision cell is coupled at the interface between a drift tube IMS stage and a TOF-MS instrument stage, but is not limited thereto. The system can include one or more operatively coupled stages including, but not limited to, e.g., drift tube ion mobility spectrometry, (DT IMS) stages; differential mobility analysis (DMA) stages; mass spectrometry (MS) stages; ion funnel trap stages; ion funnel stages; and combinations thereof. The method includes applying an axial DC-field and a substantially orthogonal RF-focusing field with respect to the ion channel axis of the collision cell; flowing a plurality of precursor ions at a pressure greater than 20 mTorr through the ion channel filled with a buffer gas; and fragmenting the precursor ions by collision with the buffer gas in the RF-focusing field, thereby generating a plurality of high-intensity, structurally-rich fragment ions inside the ion channel. The method includes applying a locally increased DC-field to accelerate the precursor ions along the ion channel axis. In axial collision induced dissociation (CID) mode, fragmenting the precursor ions includes accelerating the precursor ions axially in the DC-electric field to increase the impact velocity of the ions with the buffer gas inside the ion channel along the ion channel axis. The step of fragment ion refocusing includes collisionally cooling the fragment ions inside the ion channel to maximize the distribution and quantity of structurally-rich fragment ions inside the ion channel. The step of fragmenting includes use of a collision voltage preferably in the range from about 10 electron volts to about 100 electron volts, but voltages are not intended to be limited thereto. Fragment ions are radially confined within the RF-focusing field providing increased collection efficiency for same. Focusing the fragment ions along the axis of the ion channel using the radial RF field maximizes transmission of the ions to a subsequent analytical stage, e.g., an MS stage. The process of the invention provides a CID efficiency ($E_{CID}$) in the range from about 60% to about 90%. In RF-heating mode, the step of fragmenting includes radially displacing the precursor ions from the ion channel axis inside the collision cell by application of a DC-displacement pulse to a single quadrupole rod. The DC-displacement pulse produces a high-frequency radial RF-field that is uncompensated (i.e., not matched) by a field from an opposite rod. Precursor ions displaced from the ion channel axis have increased amplitudes of oscillation that induce fragmentation as the ions impact the buffer gas molecules. Radially-displaced fragment ions are focused back to the ion channel axis by removing the DC-displacement pulse. Relaxation of ions back to the ion channel axis results in efficient transmission of fragment ions to a subsequent instrument stage with minimum ion losses. The method can also include applying an axial DC-electric field along a center longitudinal axis of a segmented N-pole device that accelerates a beam of charged precursor ions introduced axially along the center longitudinal axis in the axial DC-electric field inside the segmented N-pole device; applying a radial DC-field that results in radial displacement of the precursor ions to a preselected region in the collision cell where uncompensated RF fields cause ion heating upon impact with the buffer gas; and fragmenting the precursor ions using both the axial DC field and RF heating by collision with neutral gas molecules in a stream of gas, producing fragment ions.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions, the various embodiments, including the preferred embodiments, have been shown and described. Included herein is a description of the best mode contemplated for carrying out the invention. As will be realized, the invention is capable of modification in various respects without departing from the invention. Accordingly, the drawings and description of the preferred embodiments set forth hereafter are to be regarded as illustrative in nature, and not as restrictive. Embodiments of the invention are described below with reference to the following accompanying drawings.

DETAILED DESCRIPTION

Figure 1:
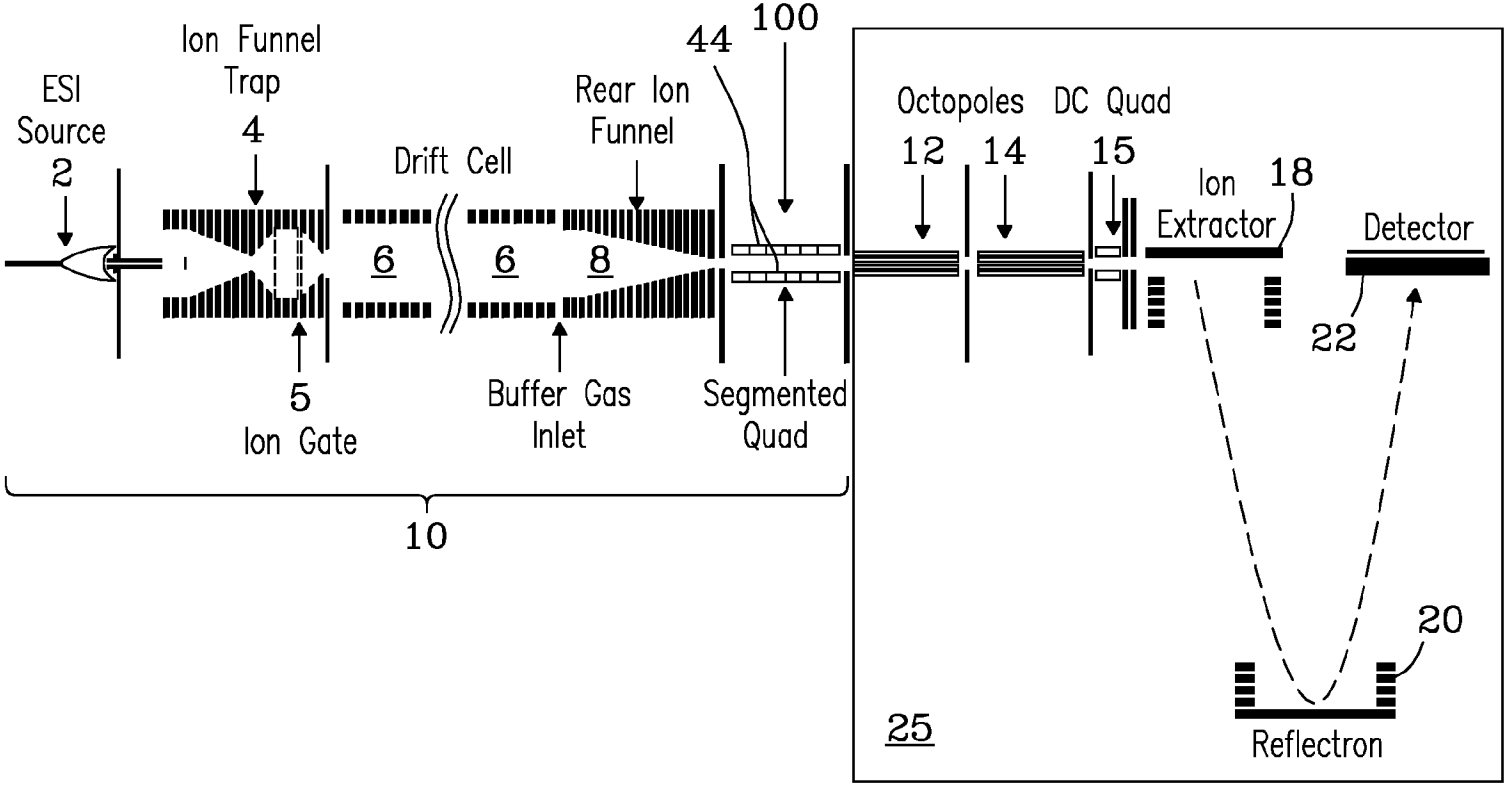
FIG. 1 shows an IMS-TOF-MS system that includes one embodiment of the invention.

The following description includes the preferred best mode of one embodiment of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible of various modifications and alternative constructions, it should be understood that there it no intention to limit the invention to the specific form disclosed, but, on the contrary, the invention covers all modifications, alternative constructions, and equivalents falling within the spirit and scope of the invention as defined in the claims. The invention provides analytical benefits in analysis of complex molecules not achieved with conventional processes and conventional devices including, but not limited to, e.g., higher sensitivity, and efficient activation. In particular, the invention fragments ions inside a collision cell in an RF-focusing field at increased collection efficiency. The invention further permits operation at a higher pressure, which can be combined seamlessly with various ion mobility mass spectrometry stages. Pressures employed within the collision cell are >20 mTorr, and typically operate at pressures of 100 mTorr and higher. As compared to conventional fragmentation approaches at 1 mTorr, the invention provides softer ion activation, and yields ~100-fold less energy per collision and 100-fold greater collisions per unit length at the same axial DC field strength, which minimizes over-fragmentation. As a result, the invention provides significantly more structurally-informative MS/MS spectra for complex ions. As used herein, the term "ion fragmentation" is used synonymously with the terms "ion activation" and "ion dissociation". The term "fragment ion" means a product ion resulting from dissociation or fragmentation Of a precursor ion. The term "residue" refers to amino acids of a peptide chain according to standard conventions: alanine (A or Ala), cysteine (C or Cys), aspartic acid (D or Asp), glutamic acid (E or Glu), phenylalanine (F or Phe), glycine (G or Gly), histidine (H or His), isoleucine (I or Ile), lysine (K or Lys), leucine (L or Leu), methionine (M or Met), asparagine (N or Asn), proline (P or Pro), glutamine (Q or Gln), arginine (R or Arg), serine (S or Ser), threonine (T or Thr), valine (V or Val), tryptophan (W or Trp), and tyrosine (Y or Tyr). A fragment ion is considered to be structurally valuable (structurally-rich) if the identity of residues in the fragment provides Sequencing information useful in the identification of a precursor (primary or parent) ion. In contrast, fragments including, but not limited to, e.g., $H_2O$ and $NH_3$ do not provide any structural information by which to identify the precursor ions. Fragments of a peptide are denoted herein by reference to charged species including, but not limited to, e.g., $a_n$ ("a-fragment"), $b_n$ ("b-fragment"), $y_n$ ("y-fragment"), and $z_n$ ("z-fragment") generated during dissociation of the peptide, where "n" denotes the residue position in the intact peptide. The fragment ion is designated as an "a" fragment (i.e., cleavage of a peptide bond behind a carbonyl residue between adjacent amino acids), "b" fragment (i.e., cleavage in front of a carbonyl residue), or "c" fragment (i.e., cleavage of in front of an N-H residue) when charge is retained on the N-terminus. By convention, residues in a "b" fragment are counted from the left-most residue to the right-most residue. Fragmentation of "b" fragment ions results in formation of "a" fragment ions. While many potential mechanisms exist for forming "a" fragment ions directly from a parent or precursor ion, it is generally accepted that "b" fragment ions lose a carbonyl (C=O) moiety (28 mass units) to form "a" fragment ions, where $a_n=b_n=28$. "X" fragment ions are generated by cleavage of a $C—C_\alpha$ bond. "Y" fragment ions result from cleavage in front of a carbonyl residue. "Z" fragment ions result from cleavage in front of an $N—C_\alpha$ bond, with charge retained on the C-terminus. By convention, "X" fragment and "Y" fragment residues are counted from the right-most residue to the left-most residue. Other common fragments include ions with masses corresponding to multiple losses of water or losses of $NH_3$, e.g., $b_n$ minus $H_2O$. Internal fragments formed by cleavage of two backbone bonds are also typical in CID and include both b-type and a-type ("b" minus 28) fragments. Internal a-type ions composed of only one amino acid are called "immonium" ions.

FIG. 1 is a schematic diagram of an IMS-TOF-MS instrument 500 of an exemplary configuration that incorporates a collision cell 100, according to one embodiment of the invention. Collision cell 100 is positioned between IMS stage 10 and TOF-MS stage 25, but location is not limited thereto. IMS stage 10 includes an ESI source 2, an ion funnel trap 4 described, e.g., by Clowers et al. [*Anal. Chem.* 2008, 80 (3), 612-623] that is further coupled to an IMS drift cell 6. IMS drift cell 6 interfaces to a (rear) ion funnel 8 described, e.g., by Belov et al. [*J. Am. Soc. Mass Spectrom.* 2000, 11 (1), 19-23] that is coupled to a conventional time-of-flight (TOF) mass spectrometer (MS) instrument (i.e., TOF-MS) 25 (e.g., an Agilent 6210 TOF-MS) available commercially (Agilent Technologies, Santa Clara, Calif., USA). In one embodiment, collision cell 100 is of a segmented quadrupole (SQ) design that incorporates segmented rods 30. In the figure, TOF-MS 25 (Agilent TechnologieS, Santa Clara, Calif.) includes two differentially-pumped multipoles (e.g., octopoles) (12, 14) that are coupled in series to a DC-quadrupole 15, an ion extractor 18, a reflection 20, and a detector 22, but components are not limited thereto.

Figure 2A:
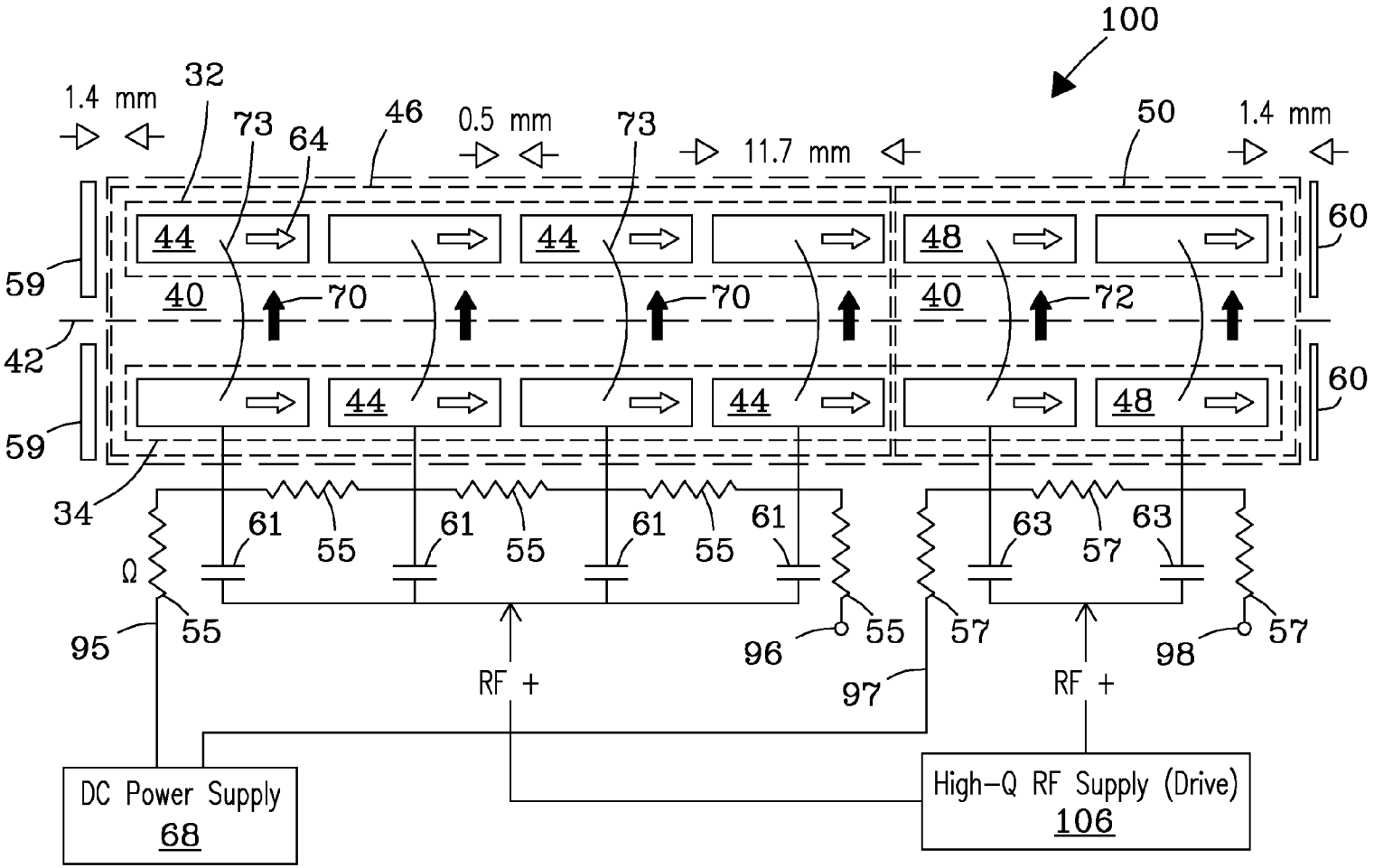
FIG. 2*a* shows one embodiment of the invention.

FIG. 2*a* shows one embodiment of collision cell 100 of the invention. Collision cell 100 includes a preselected number (N) of segmented rods, where (N) is an even-numbered integer greater than or equal to two. In the exemplary configuration, collision cell 100 includes four 4) segregated rods (32, 34, 36, 38), described further in reference to FIG. 2*b*. In FIG. 2*a* two, rods (32, 34) are shown, but number is not limited. An ion channel 40 is located between, and surrounded by, segmented rods (32, 34). A center axis 42 defined through the center of ion channel 40 provides transmission of ions to a subsequent instrument stage, e.g., an MS stage 25. Rods (32, 34) each include a fragmentation section 46 and a focusing section 50. In the exemplary embodiment, fragmentation section 46 of each rod (32, 34) includes a preselected number (e.g., 4) of electrically-coupled rod segments 44. Focusing section 50 of each rod (32, 34) also includes a preselected number (e.g., 2) of electrically-coupled rod segments 48. Segments (44, 48) individually and/or collectively deliver a preselected potential of like or different kind at preselected locations along rods (32, 34). In the exemplary configuration, each rod (32, 34) has a diameter of ~6.4 mm, with an inscribed radius (r) of 2.8 mm. Segments (44, 48) have a combined length of ~11.7 mm. Segments (44, 48) are separated by 0.5-mm polymer washers [e.g., polyetheretherketone (PEEK) washers (not shown)] that are nested between the segments (44, 48) so as not to be exposed to ions introduced to ion channel 40.

Two operationally independent resistor chains (55, 57) couple to respective segments (44, 48) of fragmentation section 46 and focusing section 50 of each rod (32, 34), e.g., as shown. Resistor chain 55 applies an axial DC gradient 64 to any individual or Collective segments 44 of section 46 for each rod (32, 34). Resistor chain 57 applies an axial DC gradient 66 to any individual or collective segments 48 of section 50 for each rod (32, 34). A DC-power supply 68 (described further in reference to FIG. 2*b*) delivers power to resistor chains (55, 57) independent of the other, providing independent operational control of DC gradients (64, 66) applied to any individual or collective segments (44, 48) of Sections (46, 50), respectively.

An RF-power drive 106 (described further in reference to FIG. 2*c*) constructed in-house of high-Q (high-quality) components delivers power for generating respective RF-fields (70, 72) that can be independently applied to individual or collective segments (44, 48) in Sections (46, 50) of collision cell 100, respectively. RF-fields (70, 72) are defined by capacitances selected for independent capacitor chains (61, 63), and by tuning of resonant frequencies for RF-fields (70, 72) applied to any individual, or groups of, segments (44, 48) in Sections (46, 50) for each rod (32, 34) of collision cell 100, respectively.

Coupling wires 73 link segments (44, 48) along rods (32, 34) allowing for selective and/or collective operation thereof. For example, in one exemplary operation, one or more rods (e.g. 32, 34) can be electrically coupled together such that a single RF-field 70 (e.g., a positive RF-field, RF+) is applied to segments 44 and a single RF-field 72 (e.g., a positive. RF-field, RF+) is applied to segments 48 of Section 50 of the coupled rods (32, 34) of collision cell 100, respectively. In an alternate mode, an independent DC-dipolar displacement pulse 102 (described further in reference to FIG. 2*b*) can be independently applied to a single rod (e.g., rod 38 described further in reference to FIG. 2*b*) in order to generate a radial. DC-displacement field, as described further herein. In addition, RF-voltages and frequencies that define RF fields (70, 72) for segments (44, 48) may be alike or different. Thus, no, limitations are intended by the exemplary descriptions. RE voltages [peak-to-peak/voltage ($V_{pp}$)] are preferably selected in the range from about 100 $V_{pp}$ to about 2000 $V_{pp}$. RF frequencies are preferably selected in the range from about 500 kHz to about 2 MHz. In one exemplary test, an RF-focusing field 72 having a peak-to-peak voltage ($V_{pp}$) of 220 V and an RF-frequency of 800 kHz was applied to segments 48 of Section 50 of segmented rods (32, 34), but operating parameters are not limited thereto. In the exemplary configuration, a DC-only conductance limiting orifice (electrode) 59 (2.2 mm I.D.) was positioned in front (i.e., 1.4 mm ahead) of segmented rods (32, 34). Another DC-only conductance limiting orifice (electrode) 60 was positioned at the rear of (i.e., 1.4 mm after) segmented rods (32, 34) of collision cell 100 in front of octopole 12, interfacing an IMS stage 10 to time-of-flight mass spectrometer (TOF-MS) 25 (see FIG. 1).

Figure 2B:
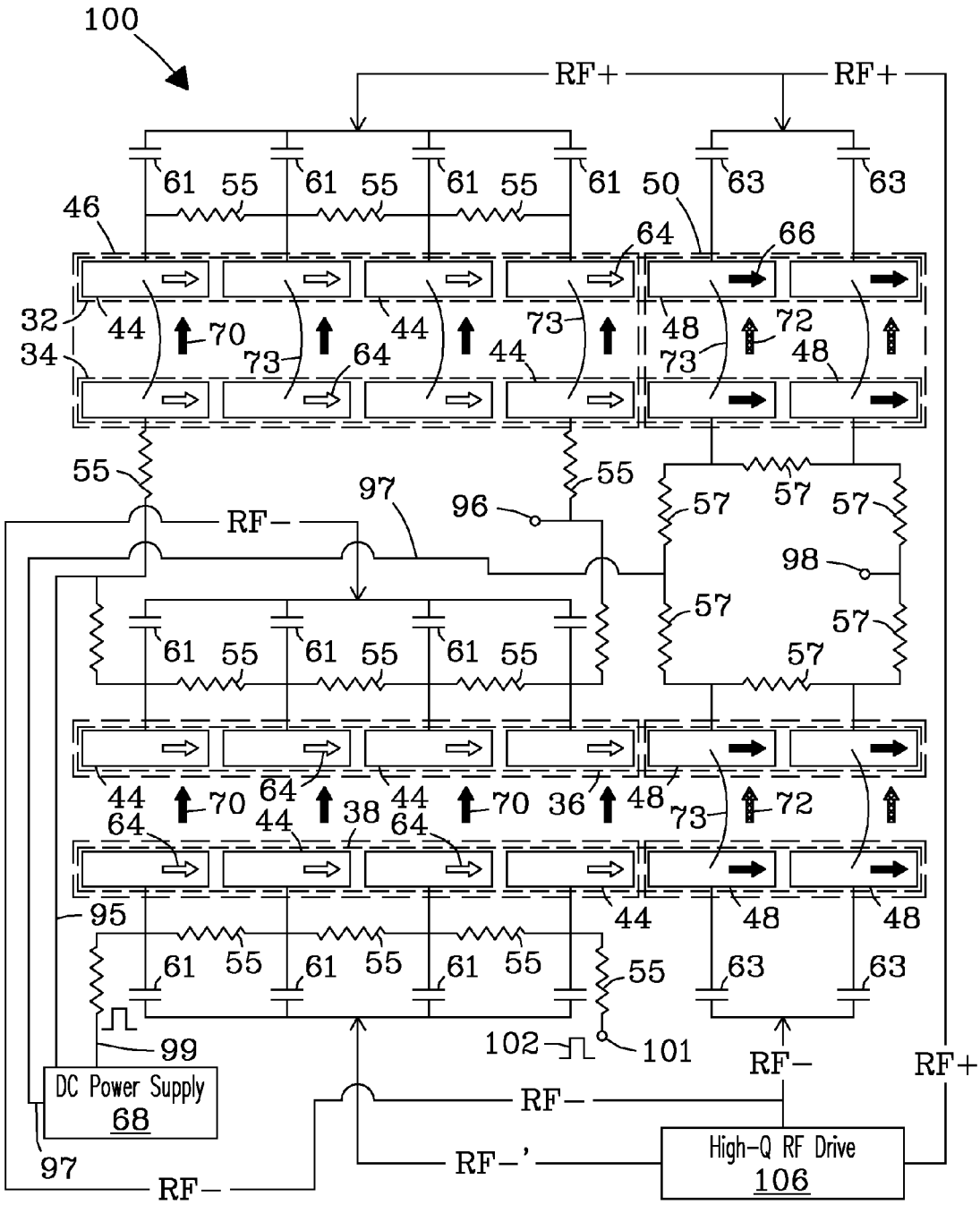
FIG. 2*b* shows another embodiment of the invention.

FIG. 2*b* shows an exemplary RF- and DC-wiring diagram for collision cell 100 that, in RF-heating mode, applies a dipolar DC-displacement pulse 102 to induce RF-heating of ions. Four rods (32, 34, 36, and 38) of collision cell 100 are shown and described. Rods (32, 34, 36, 38) of collision cell 100 each include four (4) rod segments 44 in a first fragmentation section 46 and two (2) rod segments 48 in a second focusing section 50, but number of segments is not limited thereto. RF fields (70, 72) are defined by independent capacitor chains (61, 63) that link to respective segments (44, 48) of Section 46 and Section 50, allowing RF-fields (70, 72) to be independently applied to respective segments (44, 48). Two rods (32, 34) of collision cell 100, positioned opposite one another, are electrically coupled such, that RE fields (70, 72) applied to respective segments (44, 48) by RF-power drive 106 have an identical RF-phase (e.g., RF+). Phasing of RF-waveforms that define RF-fields (70, 72) is provided by RF-amplifiers described further herein in reference to FIG. 2*c*. Segments (44, 48) of coupled rods (32, 34) are linked by coupling wires 73, e.g., as shown. In the figure, a resistor chain 55 couples to individual segments 44 of Section 46, and delivers an axial DC-gradient 64 that can be selectively applied to any of these coupled segments 44, DC gradient 64 is defined by the voltage difference between the DC (IN) terminal 95 and the DC (OUT) terminal 96 delivered by DC-power supply 68. In the instant embodiment, segments 48 of section 50 for all rods (32, 34, 36, 38) are linked via coupling wires 73. A separate resistor chain 57 couples to these segments 48, which provides a DC-gradient 66 that can be independently applied to individual or collective segments 48 of Section 50 for all rods (32, 34, 36, 38). DC gradient 66 is defined by the voltage difference between the DC (IN) terminal 97 and the DC (OUT) terminal 98 delivered by DC-power supply 68. A third segmented rod 36 has DC gradients (64, 66) selectively applied in concert with resistor chains (55, 57) that couple to individual segments (44, 48) of Sections (46, 50), respectively, as described above. A fourth rod 38 is wired to a separate resistor chain 58 independent, of those coupled to rods (32, 34, or 36) of collision cell 100. This configuration permits a specific dipolar DC-displacement pulse 102 to be applied to any individual or collective segments 44 of Section 46 of this fourth rod 38 independent of any other rods (32, 34, or 36) of collision cell 100. DC-displacement pulse 102 is defined by the voltage, difference between DC (IN) terminal 99 and DC (OUT) terminal 101 to this selected rod 38 relative to the DC gradient applied to rod 36 as delivered from DC-power supply 68. DC-displacement pulse 102, when applied, selectively displaces ions from center axis 42 within ion channel 40 inside collision cell 100. This displacement induces RF-heating of ions locally at any of a variety of predetermined locations, e.g., between selected segments (44, 48) of sections 46 and 50; or, between any individual or collective segments 44 within section 46, for example. This ability to selectively apply RF-heating of ions induces ion dissociation at these selected locations inside collision cell 100, as described further herein. The third rod 36 and fourth rod 38 are each wired to receive an RF-phase [e.g., (RF−) and, (RF−')] that is independent of that (e.g., RF+) applied to coupled rods (32, 34) by RF High-Q Drive 106 (described further herein in reference to FIG. 2*c*). Although generated independently, magnitudes of RF-phases [e.g., (RF−) and (RF−')] applied to third rod 30 and fourth rod 38 are essentially identical.

The RF- and DC-wiring configuration of the present embodiment allows RF fields (70, 72) to be independently decoupled from DC-displacement pulses 102 and from axial DC gradients (64, 66) that are applied locally to individual, or groups of, segments (44, 48) of each rod 30, respectively. Configuration of the exemplary embodiment described herein improves ion fragmentation and enhances collection efficiency inside collision cell 100. RF-phases (e.g., RF+, RF−, and RF−') generated by RF High-Q Drive 106 will now be further described.

Figure 2C:
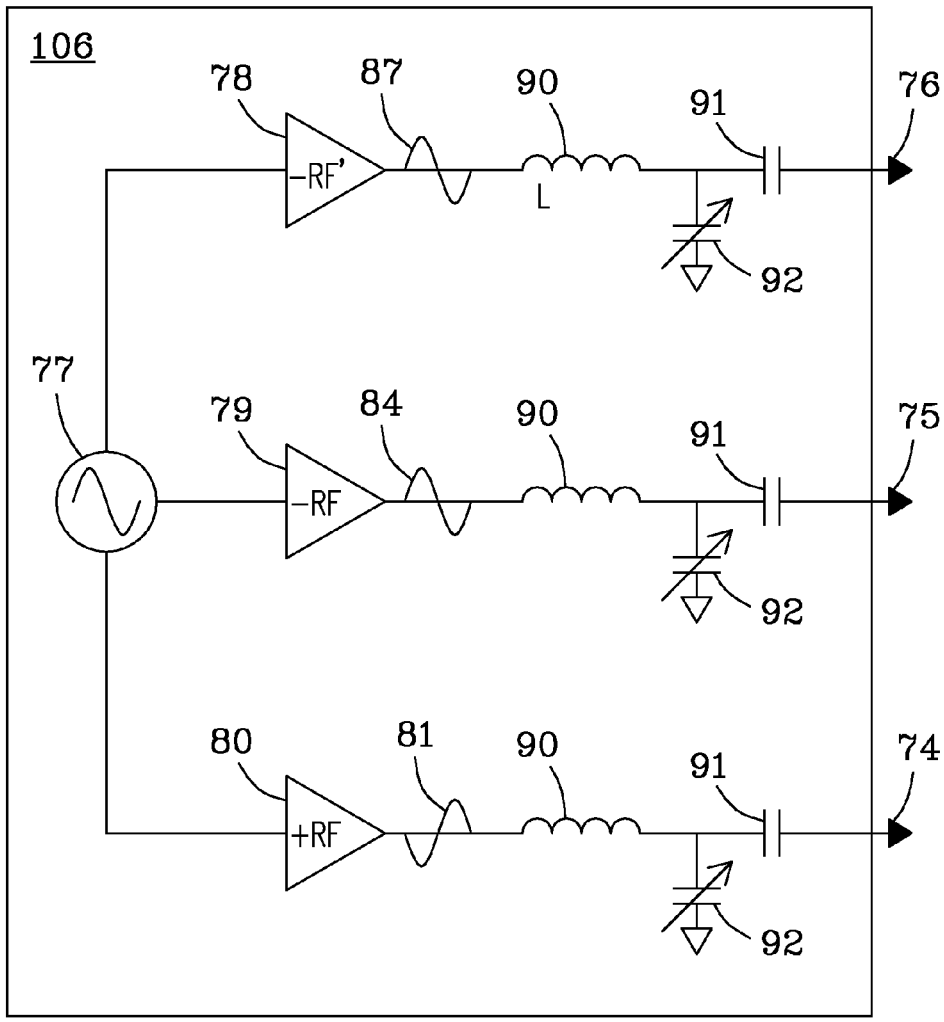
FIG. 2*c* is a schematic of a "High-Q" RF-head drive used in conjunction with the invention.

FIG. 2*c* shows a schematic of an RF High-Q head drive 106 built in-house that delivers current for driving collision cell 100. While RF head drive 106 is described in reference to segmented quadrupole rods (32, 34, 36, 38), the drive is not limited thereto and may be used for both segmented and non-segmented components described further herein. Thus, no limitations are intended. In the figure, head drive 106 is configured to deliver current to three (3) drive circuits (74, 75, 76) but number is not limited thereto. Drive circuits (74, 75, 76) are preferably of an LC resonant-circuit, or a "tank circuit", design. Drive circuits (74, 75, 76) provide radial displacement of ions, e.g., in combination with RF-fields 70 applied to any individual or collective rod segments 44 of Section 46; and further provide focusing of ions, e.g., in combination with RF-fields 72 applied to segments 48 of Section 50, described previously herein in reference to FIG. 2*b*. RF head drive 106 includes an RF-source 77 of a low current design. RF-source 77 delivers a characteristic (i.e., resonant) rise in voltage of from about 100 V to about 2000 V within each (High-"Q") drive circuit (74, 75, 76). RF sources include, but are not limited to, e.g., RF pulsed sources, RF modulators, RF signal generators, RF waveform generators, and other RF devices, as well as combinations of these devices. Drive circuits (74, 75, 76) include respective RF-amplifiers (78, 79, 80) that deliver RF-waveforms (81, 84, 87) of a preselected phase (e.g., RF+, RF−, RF−'). In each circuit (74, 75, 76), RF-amplifiers (78, 79, 80) couple to an inductor (L) 90: Typical inductor values are in the range from about 10 μH to about 50 μH. Inductor 90 in each circuit (74, 75, 76), couples to a variable capacitor 92 that provides typical capacitances from about 100 pF to about 300 pF. Inductor 90 in each circuit (74, 75, 76) further couples to a capacitor (C) 91 that provides typical capacitances from about 1 pF to about 10 pF, but capacitances are not intended to be limited thereto.

In RF-heating mode, drive circuit 74 provides a first RF waveform 81 (e.g., RF+) to two coupled rods (32, 34) described previously in reference to FIG. 2*b*. In drive: circuit 74, RF-waveform 81 (e.g., RF+) is 180 degrees out of phase with RF-waveforms 84 [e.g., (RF−)] and 87 [e.g., (RF−')] delivered from drive circuits (75, 76), respectively. Frequencies and amplitudes of RF-waveforms applied to selected segmented rods can be of the same magnitude or of a different magnitude, as will be understood by those of ordinary skill in the art. No limitations are intended. Waveform 84 [e.g., (RF−)] and waveform 87 [e.g., (RF−')] delivered from drive circuits (75, 76), respectively, are in-phase and decoupled from the other. Use of decoupled waveforms enables a specific dipolar DC-displacement pulse (FIG. 2*b*) to be applied to a single selected rod (e.g. rod 38), e.g., in conjunction with a bias source or DC power supply (described previously in reference to FIG. 2*b*). Decoupling allows an RF-displacement field 70 (e.g., RF−') to be applied to any selected rod (e.g., rod 38) that is uncompensated by RF-fields 70 [e.g., (RF+) and (RF−)] applied to other rods [e.g., to coupled rods (32, 34) and to rod 36, respectively]. This configuration allows, e.g., positively-charged ions to be radially displaced in the direction of the segmented rod having the lower DC bias voltage. For example, the uncompensated RF-field 70 applied, e.g., to selected segments (44, 48) of rod 38 provides radial displacement of ions from quadrupole axis 62, which increases the ion energy and enhances ion fragmentation.

Different DC-gradients (FIG. 2*b*) can be applied to selected rods simultaneously in combination with RF-fields described herein. RF-fields applied to each rod (32, 34, 36, 38) are defined by RF waveforms that are applied, e.g., as sine waves. In collision cell 100, each rod (32, 34, 36, 38) at any point of time has an RF field defined by the sine wave that is applied. For example, coupled rods (32, 34) can have a positive RF-field (e.g., RF+) applied, while the remaining pair of rods (36, 38) can have a negative RF-field applied (e.g., RF− and RF−', respectively). The negative RF-fields (e.g., RF− and RF−') are defined by negative sine waves (waveforms) that can be matched with the magnitude of the amplitude of the positive sine wave applied to the positive pair of rods, e.g., as described further in reference to FIG. 5*a*.

A "positive" sine wave as used herein means the waveform is 180° out-of-phase or phase-shifted by 180° relative to a "negative" sine wave (waveform). Positive ions thus experience a positive RF-field as a repulsive field on one pair of rods, while the same ions experience a negative RF field as an attractive field on another pair of rods. Due to the high frequencies of RF waveforms that define RF-fields, ions experience the oscillating, and alternating phases of the RF-fields on rods (32, 34, 36, 38) of the collision cell 100 as a potential well. In normal axial operation, the potential well has a minimum located at the center of the quadrupole. Thus, ions traverse the center axis (FIG. 2*a*) of quadrupole 100. In short, for coupled rods (32, 34) the RF amplitude is of the same magnitude. If one pair of rods is de-coupled, e.g., when two RF sine waves of the same sign and phase are applied, but have, e.g., different amplitudes, the balance between positive and negative RF-fields can affect the ion motion. In such a case, for example, ions can drift from the center axis towards one of the rods, thereby experiencing a greater oscillation due to the closeness to the rod to which the alternate RF-field is selectively applied. Such is the case in RF-heating mode described herein. In one typical approach, applying two sine waves (waveforms) of different amplitudes and the same (e.g., negative) sign and phase are applied by adding a (pulsed or continuous) DC component to the RF component that is then applied into one of the rods (e.g., rod 38) as an RF-displacement field. As used herein, the notations (RF−) and (RF−') denote an RF-field that at one moment of time is defined by a negative sine waveform having the same phase but that can be of a different amplitude. As used herein, the notation (RF+) denotes an RF-field that at one moment of time is defined by a positive sine waveform (RF+) having the same phase and same amplitude on a coupled pair of rods at the same moment. It will be understood by those of ordinary in the art that the same rods that, at one moment of time, have an (RF−) or (RF−') applied, can subsequently have an RF+) or an (RF+') waveform applied at another moment in time while the contrasting pair of rods will have an (RF−) waveform applied. No limitations are intended. All configurations as will be undertaken by those of ordinary skill in the art in view of the disclosure are within the scope of the invention.

Presence of a collisional cooling gas can further dampen the ion energy in collision cell 100. In embodiments of the invention described herein, the last two segments 48 of each rod (32, 34, 36, 38) act as RF-focusing segments. The term "RF focusing" refers to the process whereby ion motion collapses to the center axis. In RF-focusing mode, ions stay near center axis 42, while the first four segments 44 of each rod (32, 34, 36, 38) can act either as RF focusing segments (e.g., in CID mode) or as RF-displacement segments where ions are displaced from center axis 42 (e.g., in RF heating mode).

Segmented Vane Quadrupole

Figure 3A:
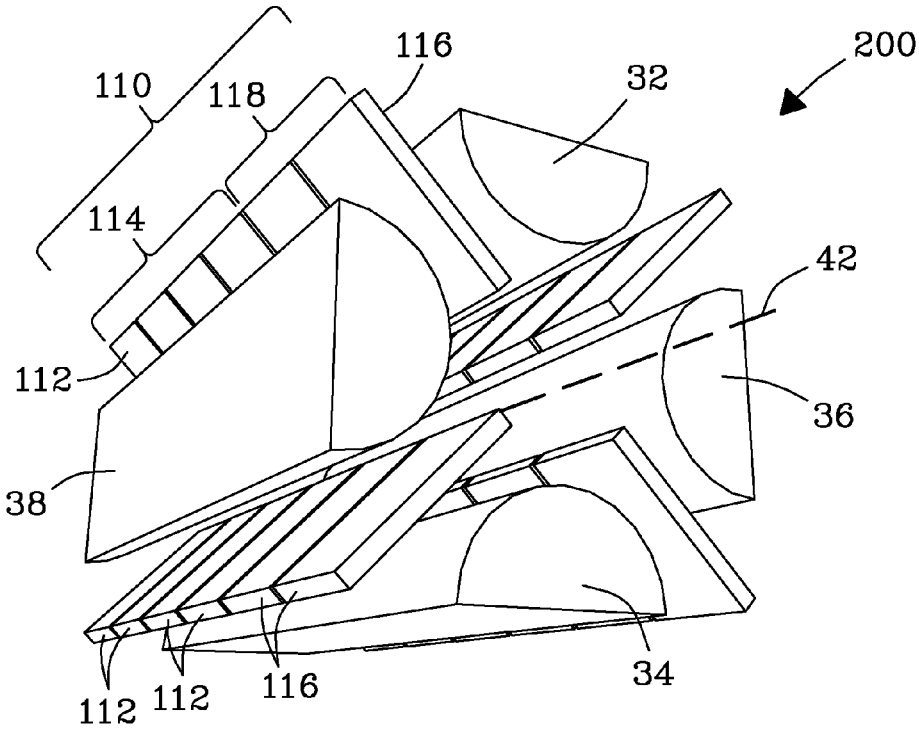
FIG. 3*a* shows another embodiment of the invention.

FIG. 3*a* is, a perspective view of another embodiment of collision cell 200 of a segmented vane design. Four vane assemblies 110 are nested between four (4) non-segmented quadrupole rods (32, 34, 36, 38) [e.g., radius (R)=3.18 mm (0.125"); inscribed radius (r)=2.79 mm (0.11")]. Each rod (32, 34, 36, 38) is adjacent two vane assemblies 110 (e.g., stainless steel, 0.5 mm-thick). Each assembly 110 includes a preselected number (e.g., 6) of vane segments (112, 116). In the exemplary embodiment, four (4) vane segments 112 define Fragmentation Section 114 and two vane segments 116 define Focusing Section 118. Each vane segment (112, 116) has a length of 11.68 mm (0.46 inches). Spacing between individual vane segments (112, 116) is ~0.5 mm (e.g., ~0.51-mm (0.02"). Vane assemblies 110 atm the decoupling of RF fields (FIG. 2*a*) from dipolar DC-displacement pulses (FIG. 2*b*) and/or from axial DC gradients (FIG. 2*a*) that are locally applied to individual segments (112, 116) along rods (32, 34, 36, 38). Each vane assembly 110 is electrically decoupled from an adjacent quadrupole rod 30, and is electrically coupled to a second vane assembly 110 using a resistor network described further herein in reference to FIG. 3*c*.

Figure 3B:
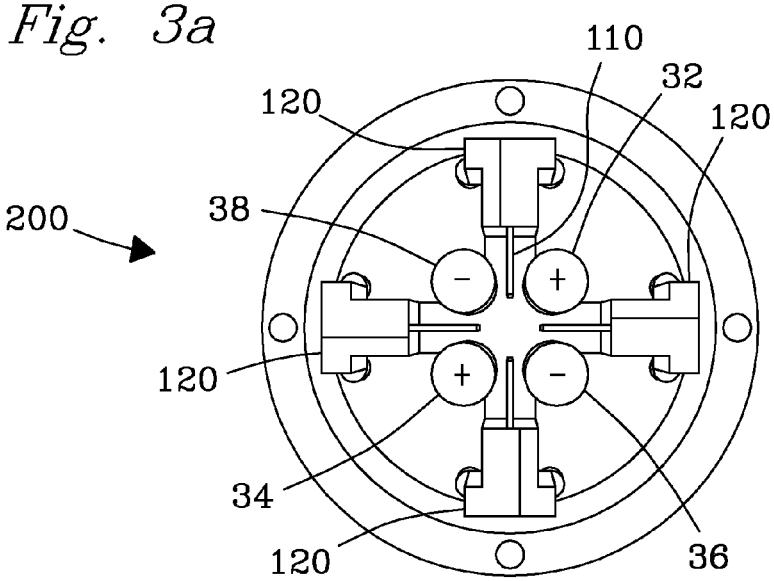
FIG. 3*b* shows another view of the embodiment of FIG. 3*a*.

FIG. 3*b* shows an end-oh (front) view of segmented vane quadrupole 200 of FIG. 3*a*. In the figure, vanes 110 are positioned such that the potential between rods (32, 34, 36, 38) is zero (i.e., the so-called "zero RF-Potential plane"). Vanes 110 are positioned using a non-conducting positioning element 120.

Figure 3C:
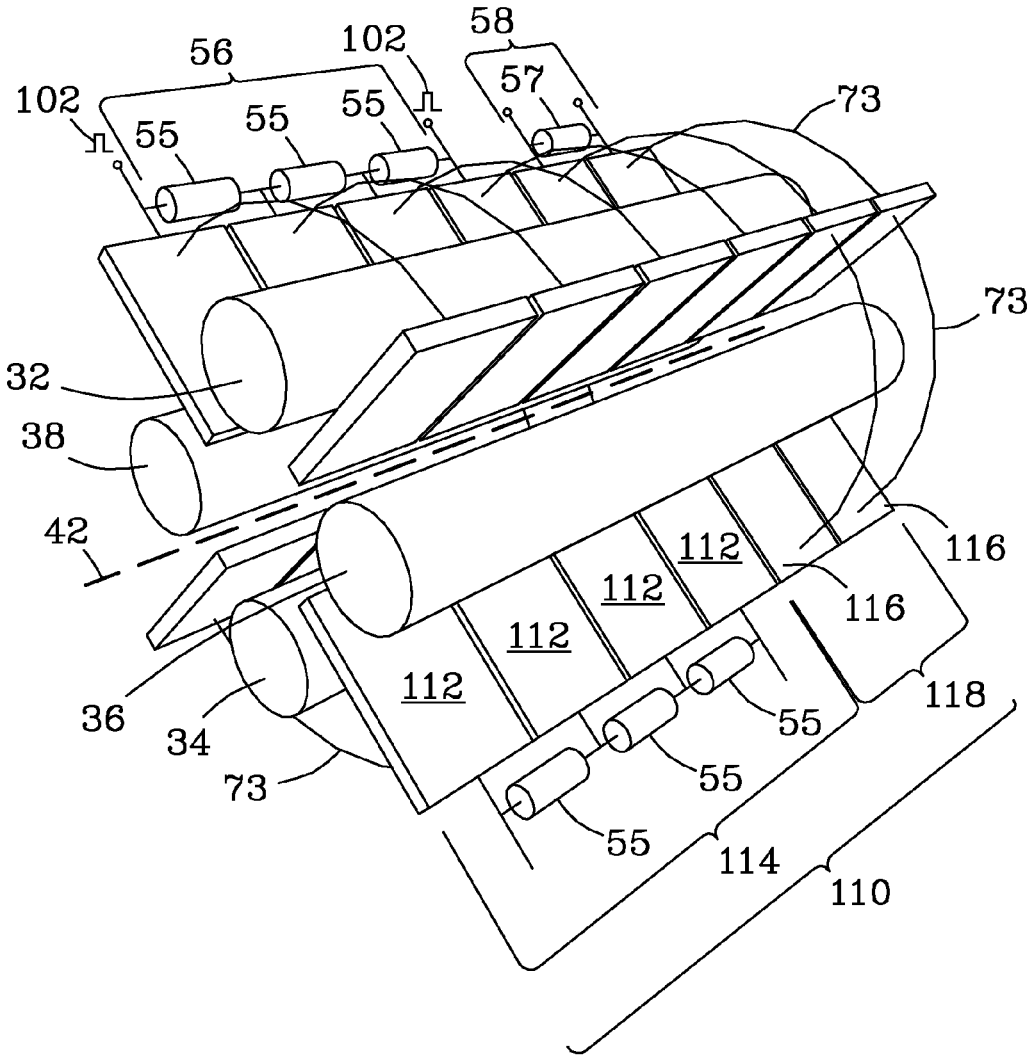
FIG. 3*c* is a wiring diagram for the embodiment of FIG. 3*b*.

FIG. 3*c* shows a wiring diagram for RF- and DC-operation of the segmented vane collision cell 200 embodiment of FIG. 3*a* in RF-heating mode. In the figure, two opposite rods (32, 34) are electrically coupled, as described previously herein in reference to FIG. 2*b*, giving them identical RF-fields [e.g., (RF+) and (RF+)], phasing, and amplitudes. While RF-fields (FIG. 2*a*) applied to rods (32, 34) are shown to be positive (i.e., RF+), potentials of specific individual cods (32, 34, 36, 38) and vanes 110 are not limited thereto. In the figure, opposed vane segments 112 in Section 114 between two vane assemblies 110 of each coupled rod (32, 34) are electrically linked via coupling wires 73. A resistor chain 55 is coupled to individual vane segments 112 of Section 114 of rods (32, 34), respectively, which allows an axial DC field gradient 64 to be independently applied to individual vane segments 112 in Section 114 for each rod (32, 34). This wiring arrangement further allows a dipolar DC-displacement pulse 102 to be superimposed over axial DC-gradient 64 applied to vane assemblies 114 surrounding rod 32, while maintaining a static axial DC-gradient 64 to vane assemblies, 110 surrounding second rod 34. Voltages applied between DC IN and DC OUT terminals (described previously in reference to FIG. 2*b*) for vane segments 112 in Section 114 of first rod 32 provides a DC-displacement pulse 102 that can be applied to selected vane segments 112 in Section 114. As described previously herein, DC-displacement pulse 102 displaces ions to a constant radial position within Section 114. Vane segments 116 in Focusing Section 118 are all coupled together via coupling wires 73. Thus, one axial DC gradient 66 is applied to all segments 116 of Section 118. A single independent resistor chain 57 establishes the axial DC gradient 66 for all segments 116 (e.g., fifth and sixth segments) of Section 118.

Fragmentation

Ion fragmentation in segmented collision cell 100 results as ions are accelerated during CID mode or during RF-heating mode as a consequence, of ion oscillation, displacement, and/or collision with gas molecules/atoms. In embodiments described previously in FIGS. 2*a*-2*c*, the invention provides ion fragmentation in a (narrow) localized region, e.g., between two adjacent segments (44, 48) of rods (32, 34, 36, 38) [e.g., between a $4^{th}$ segment 44 and $5^{th}$ segment 48, or another localized region inside collision cell 100. In embodiments described previously in FIGS. 3*a*-3*c*, ion fragmentation can also be effected in a localized (narrow) region between two adjacent segments (112, 116) of vanes 110 [e.g., between a $4^{th}$ segment 112 and a $5^{th}$ segment 116, or another localized region inside vane collision cell 100. DC- and RF-fields applied to rod segments (44, 48) or vane segments (112, 116) vary locally in time and ensure efficient decomposition of analyte precursor ions that exit IMS drift cell stage 10. This localized fragmentation provided by the invention provides two primary advantages. First, a limited region of ion activation is maintained in quadrupole 100, which ensures: 1) that numerous collisions are obtained, and 2) that excessive fragmentation is mitigated such that both multiply-charged and singly-charged ions decompose to give structurally-rich, informative fragment ions. Optimum collision energies can be selected for precursor ions of interest because fields can be applied to specific and individual segments. Ions accelerated by the axial electric field are first activated inside ion channel 40 of collision cell 100, which leads to an abundance of primary fragments.

Fragmentation is followed by collisional cooling of fragment ions and any remaining parent (precursor) ions, which results in a narrowing of the internal energy distribution of both fragment ions and remaining precursor ions. Thus, all ions dispersed during the collision process are subsequently re-collimated to ion channel axis 42 by a radially confining RF-focusing field 72. Experiments described hereafter were performed at a pressure of 200 mTorr inside collision cell (segmented quadrupole) 100, but pressure is not limited thereto. In experiments deploying a drift tube IMS stage 10, a voltage drop of ~5 V was applied to each segment 44 in Section 46 of segmented quadrupole rods (32, 34, 36, 38) to reduce residence time of ions in collision cell 100, thus minimizing peak dispersion in the drift time domain. DC voltages applied to exit segments 48 of Section 50 and conductance limiting orifice 60 were kept within ~5 Volts of the DC-bias (~32 V) applied to octopole 12 of TOF-MS stage 25 in order to optimize sensitivity, but parameters are not limited thereto.

Three fragmentation modes will now be described: 1) CID mode, 2) RF-heating Mode, and 3) combined axial CID and RF-heating mode.

Axial CID Mode

Figure 4:
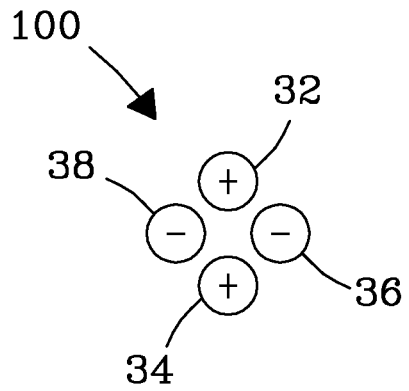
FIG. 4 shows RF-phases applied in CID mode, according to another embodiment of the process of the invention.

FIG. 4 is an end-on view of segmented rods (32, 34, 36, 38) that shows RF-field phases applied to collision cell 100 for operation in axial CID mode. In the figure, two quadrupole rods (32, 34) each have an RF-field 70 applied with a first RF-phase (e.g., RF+). Another two quadrupole rods (36, 38) each have an RF-field 70 applied, both with an opposite RF phase (e.g., RF−), e.g., as, shown, but operation is, not limited thereto, as detailed herein. In preferred operation, [i.e., in collision-induced-dissociation (CID) mode], a locally and selectively positioned voltage differential is applied, e.g., between two selected segments (44, 48) of each rod (32, 34, 36, 38) in collision cell 100, as described previously herein that provides ion dissociation and fragmentation inside ion channel 40. In collision cell 100, the buffer gas used is a neutral gas including, but not limited to, e.g., nitrogen and argon used at high pressure, e.g., a pressure greater than about 20 mTorr. In an exemplary embodiment of the process, ion dissociation by CID was effected, and demonstrated, between the $4^{th}$ segment 44 of Section 46 and the $5^{th}$ segment 48 of Section 50. In this mode, an axial DC-field (64, 66) voltage of equal magnitude is first established across all segments (44, 48) of rods (32, 34, 36, 38), which does not lead to ion fragmentation. Ion fragmentation by CID is then effected by increasing the axial DC-electric field (gradient) 64 between, e.g., the $4^{th}$ segment 44 and the $5^{th}$ segment 48 inside collision cell 100 (FIG. 2*a*) while keeping axial DC-electric field 66 unchanged for the rest (i.e., remaining length) of each rod (32, 34, 36, 38). In the exemplary case, for example, axial DC-field 64 (bias) voltage applied to the four segments 44 of Section 46 can be increased by, e.g., up to 200 V relative to the (bias) voltage of the axial DC-field 66 applied to segments 48 of Section 50, but is not limited thereto. This localized increase in axial DC-gradient 64 between selected segments (44, 48) accelerates ions in the selected region (i.e., proportional to the applied DC-field), increasing their ion kinetic energy. This increase in kinetic energy induces on-axis collisions between the precursor ions and buffer gas molecules leading into Section 50 within RF-focusing field 70, resulting in fragmentation of the precursor ions. In the exemplary case, increasing the voltage difference between the $4^{th}$ segment 44 of Section 46 and the $5^{th}$ segment 48 of Section 50 accelerates ions in the selected region, increasing the velocity of impact between the precursor ions and the collision gas molecules between selected segments where locally selected voltage differences are applied, thus facilitating productive ion fragmentation in that localized and selected region. Alternate, segments can also be selected for CID fragmentation, as will be understood by those of ordinary skill in the art. Thus, the invention is not intended to be limited by the description to: the exemplary operation. After exiting the selected region between, e.g., segments 4 and 5, (or another localized region) where locally elevated DC-gradients (64, 66) are selectively positioned, fragment ions are then collisionally cooled by the buffer gas. Ions are then focused to ion axis 42 using radial RF-focusing field 72, which facilitates efficient transmission of fragment ions to mass spectrometer stage 25 for detection.

RF-Heating Mode

Figure 5A:
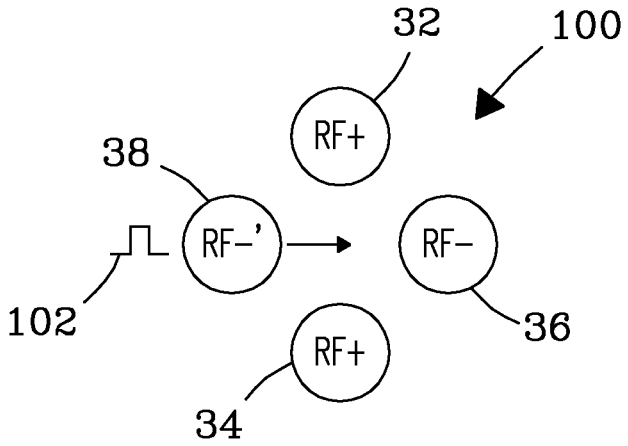
FIG. 5*a* shows a dipolar DC-displacement pulse applied in conjunction with the invention.

FIG. 5*a* is an end-on (front) view of collision cell 100 in RF-heating mode. Two opposite rods (32, 34) are coupled such that RF-fields 68 applied to these rods are identical in phase type (e.g., RF+) and magnitude. The voltage applied to rod 32 or segment (44, 48) of that rod is experienced by the opposite rod 34 or segment (44, 48), and vice versa. In the figure, remaining rods (36, 38) are not coupled so that voltages applied to one rod 36, or individual segments (44, 48) of that rod 36, are applied independently of voltages applied to the other rod 38. This allows rod 38 to Which an (RF−') phase is applied to be pulsed, although the selection of rod is not limited, thereto. Rods (36, 38) have the same polarity (e.g., RF− and RF−') and essentially an equal magnitude, initially. Thus, ion energy is minimized (e.g., at the bottom of the pseudopotential energy well) due to fully compensated RF-fields (e.g., RF− and RF−') from opposing rods (32, 34) and (36, 38) of collision cell 100. In RF-heating mode, a DC-displacement pulse 102 is superimposed (applied) to one of the uncoupled rods, e.g., rod 38, or segments (44, 48) of rod 38. DC-displacement pulse 102, generates a high RF-field 70 (e.g., RF−') that is uncompensated (i.e., not matched) by the opposite rod 36 or segments (44, 48) of rod 36 because the rod 36 is not physically coupled to is independent of) the opposite rod 38. For example, pulsing selected segments 44 of a single rod 38 with dipolar DC-displacement pulse 102 displaces ions radially from center axis 42 in a localized area selected, e.g., within, or between, segments (e.g., between segments 1, 2, 3, and 4 of Section 46) inside collision cell 100.

Figure 5B:
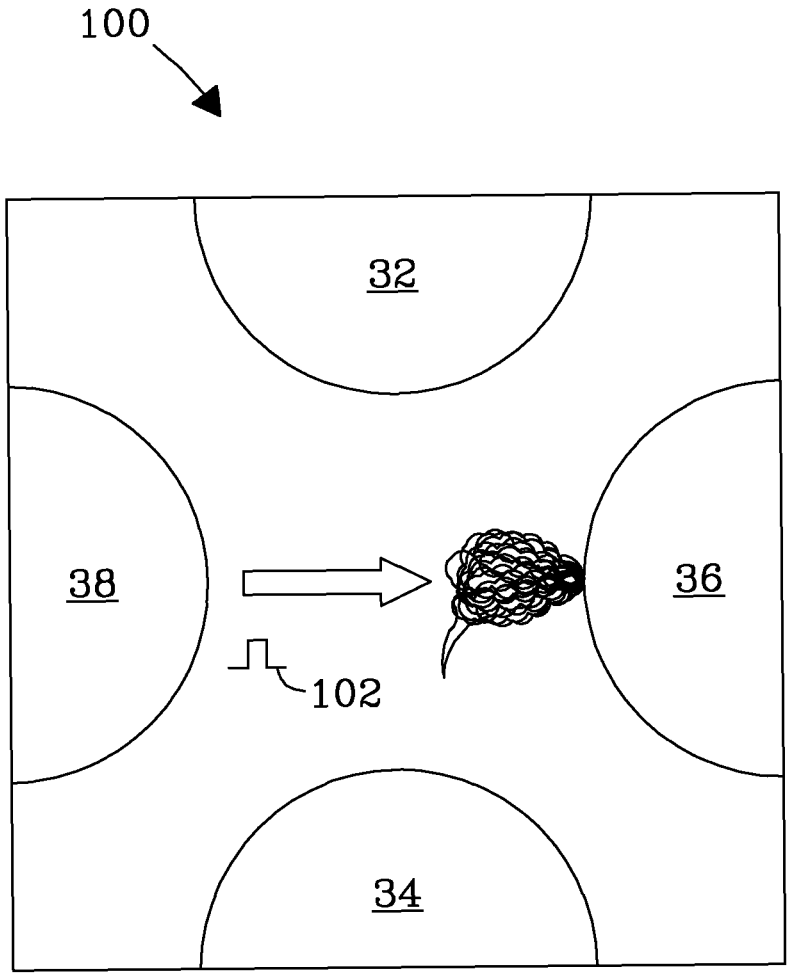
FIG. 5*b* shows the off-axis radial displacement of ions achieved with an embodiment of the invention.

FIG. 5*b* is an, end-on (front) view of collision cell 100 (segmented quadrupole design) that shows the radial displacement of ions achieved by the dipolar DC-displacement pulse 102. In the figure, ions are shifted off the center axis 42 away from rod 38 closer to opposed rod 36.

Figure 5C:
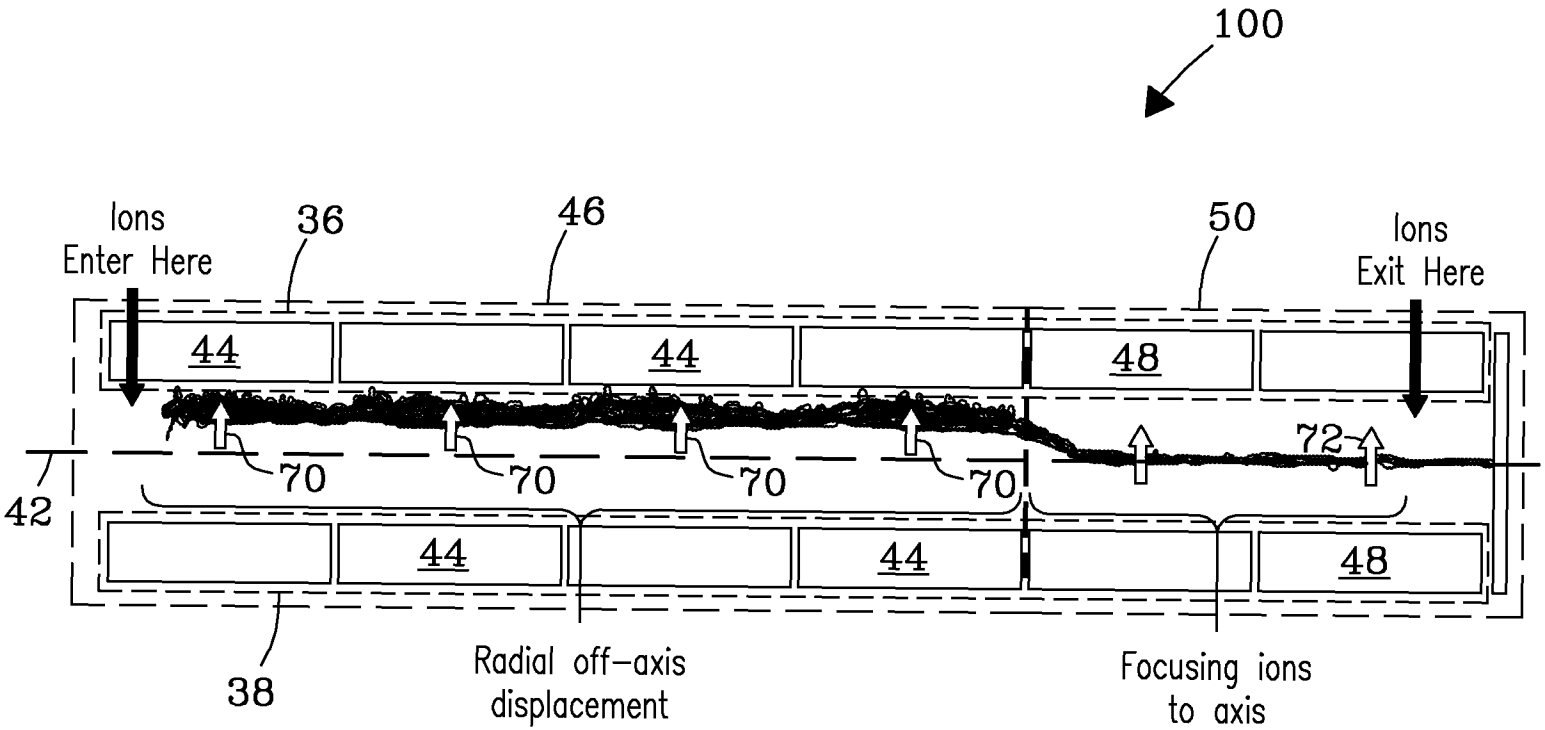
FIG. 5*c* shows another view of the off-axis radial displacement of ions achieved with an embodiment the invention.

FIG. 5C shows a horizontal cross-sectional view through collision cell 100 in RF-heating mode. In the figure, a SIMION simulation shows the radial off-axis displacement of ions achieved: by dipolar DC-displacement pulse 102 when applied, e.g., between the $1^{st}$ and $4^{th}$ segments 44 of, Section 46. While an exemplary localized area is shown, area to which displacement pulse 102 is applied inside collision cell 100 is not limited. In the figure, ions are displaced (i.e., off-axis) from ion channel (center) axis 42. The radial displacement of ions from the center axis using the uncompensated RF-field 70 increases the ion energy (i.e., up the pseudopotential energy well), given that the RF-field 70 on rod 38 is not compensated by an opposite rod 36. The uncompensated high-frequency RF-field 70 in Section 46 increases the amplitudes of ion oscillation, resulting in higher energy collisions with the buffer gas, and an increase in the ion temperature. As ions are pushed by the radial DC-displacement pulse 102 from ion channel axis 42 from one rod 38 toward an opposite rod 36, associated ion temperatures increase, which induces fragmentation of the precursor ions as the ions impact with buffer gas molecules. All of these factors: increased amplitudes of ion oscillation; higher energy collisions; and increased ion temperatures can individually or collectively effect ion dissociation. Temperature of the ions is controlled by the extent of radial displacement, which in turn is a function of the magnitude of the applied dipolar DC-pulse, and the amplitude and frequency of the RF field. Ion activation in RF-heating mode has been shown to be broadband, meaning the process causes no m/z discrimination. The term "m/z discrimination" refers to the suppression of signals of certain m/z ions. Displaced fragment ions are subsequently focused (re-collimated) back to ion channel axis 42 by applying an RF-focusing (confinement) field described: previously herein 72, e.g., along the last two (e.g., 5th and 6th) segments 48 of Section 50. This refocusing results in collisional-cooling of ions with the buffer gas, and associated relaxation of the fragment ions back to the center axis 42. Radial confinement of fragment ions back into the ion channel axis 42 with RF-focusing, field 72 minimizes ion losses, which provides effective coupling of collision cell 100 for high and efficient transmission of fragment ions, e.g., to a subsequent instrument stage 25. In the figure, fragment ions are transmitted through limit (CL) interface 60 into mass spectrometer (FIG. 2*a*).

Combined Axial CID and RF-Heating Mode

While ion dissociation has been described in reference to individual modes, e.g., CID mode and RF-heating mode, respectively, the invention is not limited thereto, as described hereafter. For example, off-axis RF-heating in conjunction with RF-fields (70, 72) can also be combined with collision-induced dissociation in conjunction with axial DC fields (64, 66) to attain higher fragmentation efficiency for larger molecules. For example, in other embodiments of the invention, ion dissociation can be induced using a combination of both RF-heating and CID. In the combined mode, precursor ions are first displaced from center axis 42 of collision cell 100 with a DC displacement pulse 102, applied to one of the segmented rods (32, 34, 36, 38), as described previously in reference to FIG. 5*a*. This subjects them to a high-frequency RF field 70 and localized heating (i.e., by RF-heating). Displaced ions are then subjected to a localized drop in voltage between two selected segments, e.g., between a $4^{th}$ segment 44 of Section 46 and a $5^{th}$ segment 48 of Section 50 in segmented collision, cell 100. This localized drop in voltage subjects the ions to axial collision with the buffer gas, inducing ion fragmentation by CID. This process thus combines the effects of both: 1) RF heating in RF-heating mode that increases ion energy, and 2) CID resulting from collisions with the buffet gas, which enhances fragmentation of the precursor ions. Axial DC-field 64 is increased, e.g., in the region between the $4^{th}$ segment 44 of Section 46 and the $5^{th}$ segment 48 of Section 50. Once these selected quadrupole segments are energized at different potentials, axial DC field (gradient) 64 is concurrently generated parallel to ion axis 42 of collision cell 100. Axial DC-field 64 decreases to zero on the surface of segments 44 and remains high between segments 44. Axial DC-field 66 also decreases to zero on the surface of segments 48 and remains high between segments 48. Therefore, if an ion is radially displaced off-axis 42, and then traverses collision cell 100 near the surface of segments 44 (e.g., between the $4^{th}$ segment 44 and the $5^{th}$ segment 48, the ion accelerates between segments (54, 55) just as it would along quadrupole axis 42. Thus, axial DC-field 64 is generated not only on the quadrupole axis 42, but also near the surface of between selected segments (44, 48). However, for ions approaching rods 30 in the radial direction, axial DC-field 64 gets lower along the segment surface (i.e., at the extreme, field 64 is zero on the surface), and remains high between segments (44, 48). In this fashion, precursor ions gain energy from both DC-fields (64, 66) and RF-fields (70, 72) and combined. Contributions to internal ion energy from each of the individual or combined fields can be varied by adjusting: 1) amplitude of the radial-displacement pulse 102, 2) RF amplitude and frequency, and 3) axial DC-gradients (64, 66). When axial DC gradient 64 is reduced in Section 48 (FIG. 2) and radial-displacement field 70 is removed, ions are re-collimated back to ion channel axis 42 of collision cell 100, and collisional cooling of internal degrees of ion freedom occurs.

Fragmentation Efficiency and Collection Efficiency

Collection Efficiency ($E_c$) is defined as the ratio of the sum of intensities of all fragments ($f_i$) and remaining precursor ions (P) to the initial (MS-only) precursor ion ($P_0$) intensity, as given by Equation [1]:

$$\text{Collection Efficiency: } E_c = \frac{P + \sum f_i}{P_0} \quad [1]$$

Fragmentation Efficiency ($E_f$) is defined as the ratio of intensities of all fragments ($f_i$) to the sum of intensities of both the remaining precursor ions (P) and all fragments ($f_i$), as given by Equation [2]:

$$\text{Fragmentation Efficiency: } E_f = \frac{\sum f_i}{P + \sum f_i} \quad [2]$$

Collision Induced Dissociation (CID) Efficiency ($E_{CID}$) is defined as the ratio of intensities of all fragments ($f_i$) to the initial (MS-only) precursor ion ($P_0$) intensity. It is also determined as the product of the collection and fragmentation efficiencies, as given by Equation [3]:

$$CID \text{ Efficiency: } E_{CID} = E_c \times E_f = \frac{\sum f_i}{P_0} \quad [3]$$

Here, ($P_0$) is the intensity of the precursor ion, (P) is the surviving precursor ion intensity in the CID spectrum, ($\Sigma f_i$) is the sum of all fragment intensities in the CID spectrum. ($E_c$) accounts for losses due to ion scattering/defocusing during the collision process. ($E_f$) reflects the efficiency of producing fragment ions. ($E_{CID}$) is the Overall CID efficiency, which incorporates both the fragmentation and collection efficiency.

The effective potential (V*) is given by Equation [4], as follows:

$$V^*(r, z) = \frac{q^2 E_{rf}^2(r, z)}{4m\omega^2} \quad [4]$$

Here, q=ze is the ion charge; [$E_{rf}$(r,z)] is the amplitude of the RF electric field; (m) is the ion mass, and (ω) is the angular frequency of the RF field. The DC gradient is superimposed on V* to generate a full effective potential.

Fragmentation Results

CID Mode

The invention system and process were assessed using various CID efficiency values, and other factors, including, e.g., collection and fragmentation efficiencies. CID efficiencies were assessed by examining CID spectra for a variety of peptides.

Figure 6:
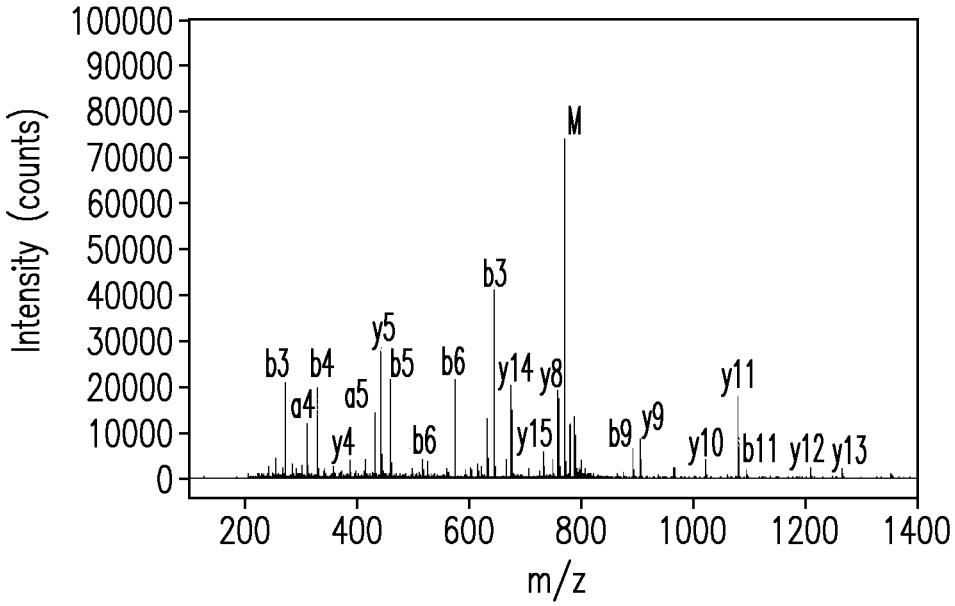
FIG. 6 is a mass spectrum of fragments obtained for $[\text{Fibrinopeptide-A}]^{2+}$ ions (SEQ. ID. NO.: 1) in CID mode.

FIG. 6 shows a typical CID mass spectrum for [Fibrinopeptide-A]$^{2+}$ precursor ions (768.8498 m/z) having the sequence set forth in [SEQ ID NO.: 1] that were collisionally activated (fragmented) by the process of the invention inside the segmented quadrupole (SQ) collision cell at a collision voltage of 45 V. Inducing fragmentation inside the SQ resulted in detection of 21 high-intensity, structure-revealing fragments [i.e., a4, a5, b3 (quantity 2), b4, b5, b6 (quantity 2), b9, b11, y4, y5, y8, y9, y10, y11, y12, y13, y14, and y15] including the precursor ion (M). Optimum CID efficiency was determined by adjusting the electric field strength (i.e., collision energy) in the region between the $4^{th}$ and $5^{th}$ segments (44, 48) while maintaining a constant DC-gradient in other regions of collision cell 100, as described previously in reference to FIG. 2*a*.

Figure 7:
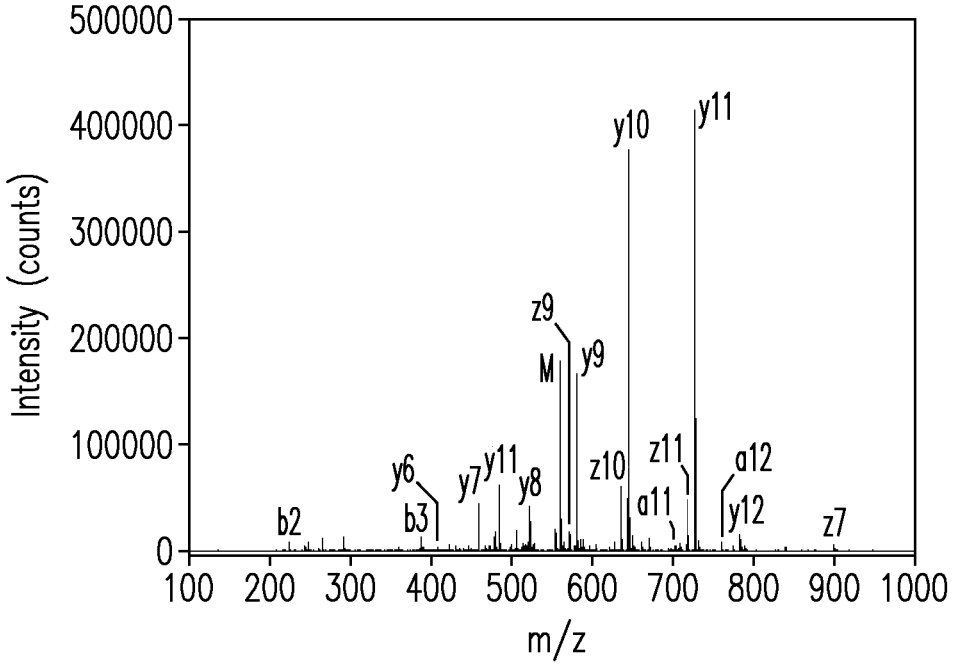
FIG. 7 is a mass spectrum of fragments obtained for $[\text{Neurotensin}]^{3+}$ ions (SEQ. ID. NO.: 2) in CID mode.

FIG. 7 is a CID mass spectrum obtained by the process of the invention for [Neurotensin]$^{3+}$ precursor ions (having the sequence set forth in [SEQ ID NO.: 2]) that shows ion fragments obtained from dissociation inside collision cell 100. Precursor ions for [Neurotensin]$^{3+}$ (558.3105 m/z) were collisionally-activated inside the segmented quadrupole (SQ) at an exemplary collision voltage of 40 V, which is not limited. In the figure, the CID spectrum obtained with the CID approach shows a total of 22 high-intensity, structurally-revealing fragments, including, e.g., a11, a12, b2, b3, y6, y7, y8, y9, y10, y11, y12, z7, z9, z10, z11, and the precursor ion (M). Fragment ions were confidently identified using, a mass accuracy of ±10 ppm, but is not limited thereto.

TABLE 1 lists Collection Efficiency ($E_c$), Fragmentation Efficiency ($E_f$), and CID Efficiency ($E_{CID}$) data for the segmented quadrupole (SQ) in accordance with the invention at different voltage settings in tests performed on [Fibrinopeptide-A]$^{2+}$ (SEQ. ID. NO.: 1) and [Neurotensin]$^{3+}$ (SEQ. ID. NO.: 2) precursor ions.

TABLE 1

Collection Efficiency ($E_c$), Fragmentation Efficiency ($E_f$), and CID Efficiency ($E_{CID}$) for [Fibrinopeptide-A]$^{2+}$ and [Neurotensin]$^{3+}$ precursor ions inside the segmented quadrupole (SQ).

| V | $E_c$ | $E_f$ | $E_{CID}$ |
|---|---|---|---|
| [Fibrinopeptide-A]$^{2+}$ (SEQ. ID. NO.: 1) | | | |
| 37 | 0.75 | 0.37 | 0.27 |
| 39 | 0.74 | 0.47 | 0.35 |
| 40 | 0.73 | 0.55 | 0.40 |
| 42 | 0.67 | 0.64 | 0.43 |
| 45 | 0.62 | 0.84 | 0.52 |
| 47 | 0.64 | 0.92 | 0.59 |
| 50 | 0.63 | 0.97 | 0.61 |
| 55 | 0.60 | 1.00 | 0.60 |
| [Neurotensin]$^{3+}$ (SEQ. ID. NO.: 2) | | | |
| 80 | 0.64 | 0.94 | 0.60 |

V = collision voltage (volts).
$E_c$ = collection efficiency.
$E_f$ = fragmentation efficiency.
$E_{CID}$ = CID efficiency.

As Shown in the table, fragmentation efficiencies ($E_f$) increased from 0.37 to 1.00 (37% to 100%) as collision voltages increased. Data also show that the segmented quadrupole (SQ) collision cell of the invention demonstrated a high collection efficiency, which is ascribed to better ion confinement in the segmented quadrupole following collision-induced fragmentation of the ions. At low collision voltages and low collision energies, ion loss due to ion defocusing and scattering is low, which leads to a high collection efficiency observed for the CID approach (i.e., 75%). At a higher acceleration voltage of 55 V (volts), the collection efficiency decreases to 0.60 (60%). From Equation [4], the effective potential of the segmented, quadrupole (SQ) collision cell was calculated under simulated conditions for the CID of $[\text{Neurotensin}]^{3+}$ ions (SEQ. ID. NO.: 2) using an exemplary collision voltage of 35 V (volts) applied between the $4^{th}$ and $5^{th}$ segments. Data indicate that inducing CID inside the RF-focusing field minimizes ions losses by confining the fragment ions. Inducing CID inside the quadrupole also allows collision products to be refocused into the axis of the quadrupole, which leads to effective transmission of product ions downstream through downstream ion optics into the mass spectrometer stage.

CID efficiency trends have also been observed for other peptides, including, but not limited to, e.g., Angiotensin-I (SEQ. ID. NO. 3) (Sigma-Aldrich, St. Louis, Mo., USA), Leucine Enkephalin (SEQ. ID. NO. 4), Methionine Enkephalin (SEQ. ID. NO. 5), Bradykinin (SEQ. ID. NO. 6), and tryptic digests of different proteins including, e.g., Bovine Serum Albumin (SEQ. ID. NO. 7) (Pierce Biotechnology, Rockford, Ill., USA): CID efficiencies for singly-charged Species in the IMS-CID-TOF instrument in accordance with the invention were comparable to those obtained from a conventional triple-quadrupole instrument. In particular, CID efficiency for singly-charged Leucine Enkephalin (SEQ. ID. NO. 4) (m/z 556) in the triple-quadrupole instrument was measured at 36%; a CID of 36% was also obtained in the IMS-CID-TOF instrument. The CID efficiency obtained for Methionine Enkephalin (SEQ. ID. NO. 5) in the conventional triple-quadrupole instrument was 39%.

The difference in $E_{CID}$ values obtained for the triple-quadrupole instrument and IMS-CID-TOF approach in accordance with the invention becomes more pronounced when comparing multiply charged species such as double-charged. Fibrinopeptide-A ions (SEQ. ID. NO. 1) and triple-charged $[\text{Neurotensin}]^{3+}$ ions (SEQ. ID. NO. 2). $E_{CID}$ values of 17% and 10% were obtained for the double-charged Fibrinopeptide-A ions (SEQ. ID. NO. 1) and triple-charged $[\text{Neurotensin}]^{3+}$ ions (SEQ. ID. NO. 2), respectively, in the conventional triple-quadrupole instrument. These. $E_{CID}$ values are lower than those obtained in the IMS-CID-TOF instrument in accordance with the invention by factors of 3.6 and 6, respectively, (See TABLE 1).

The (m/z) distribution Of CID products for all studied peptides obtained in conjunction with the invention was broad. The broad range of in fragments produces a rich informational content by which to assess the structure of precursor ions. The content-rich MS spectra were attributed to precursor ions that were properly thermalized and that had a narrow internal energy distribution. Even at high collision energies sufficient to completely fragment all precursor ions [e.g., at collision energies greater than 60 V times (×) charge], typically, only a few fragments were observed at m/z values <200 amu. This finding is significant because the region below 200 amu typically contains secondary fragments (i.e., fragments produced from primary fragments within the same, collision cell) and small fragments such as immonium ions.

These data demonstrate the advantages of inducing ion fragmentation at a higher pressure (e.g., 200 mTorr) inside the segmented quadrupole. The invention approach is characterized by more effective radial confinement of both precursor and fragment ions. Use of the higher pressure inside the segmented quadrupole also helps to collisionally cool: 1) the precursor ions before dissociation and before being accelerated and fragmented, and 2) fragmentation products following dissociation. Collisional cooling requires, at a minimum, a number [N] of collisions to occur along the length of the focusing device, as defined by Equation [5]:

$$N = \frac{M_{ion}}{m_{gas}} \quad [5]$$

The length of the focusing device (L) Should be greater than ion relaxation length (λ), as given by Equation [6]:

$$\lambda = C\frac{M_{ion}}{m_{gas}}\frac{1}{n\sigma} \quad [6]$$

Here, (C) is the proportionality coefficient (~¾); ($M_{ion}$) is the ion mass; ($M_{gas}$) is the mass of the gas molecules; (n) is the gas number density; and (σ) is the ion collisional cross section. Values Selected for pressure and collision energy are sufficient to reproduce, the results obtained. CID efficiency (calculated as the ratio of the summed intensity of all fragment ions to the initial intensity of the precursor ion) is independent of the mode of ion activation (e.g., CID mode, RF-heating mode, or combined RF-beating and CID mode]. That is, it is decoupled from the efficiency values obtained in the experiment. Data shown in TABLE 1 demonstrate the superior performance of the CID approach inside the segmented quadrupole. In particular, results show an ($E_{CID}$) of 0.60 (i.e., 60%) under optimum conditions. The high CID efficiencies obtained are attributed to the ability of the segmented quadrupole to capture CID products at a high efficiency.

Fragmentation Results

RF-Heating Mode

Figure 8:
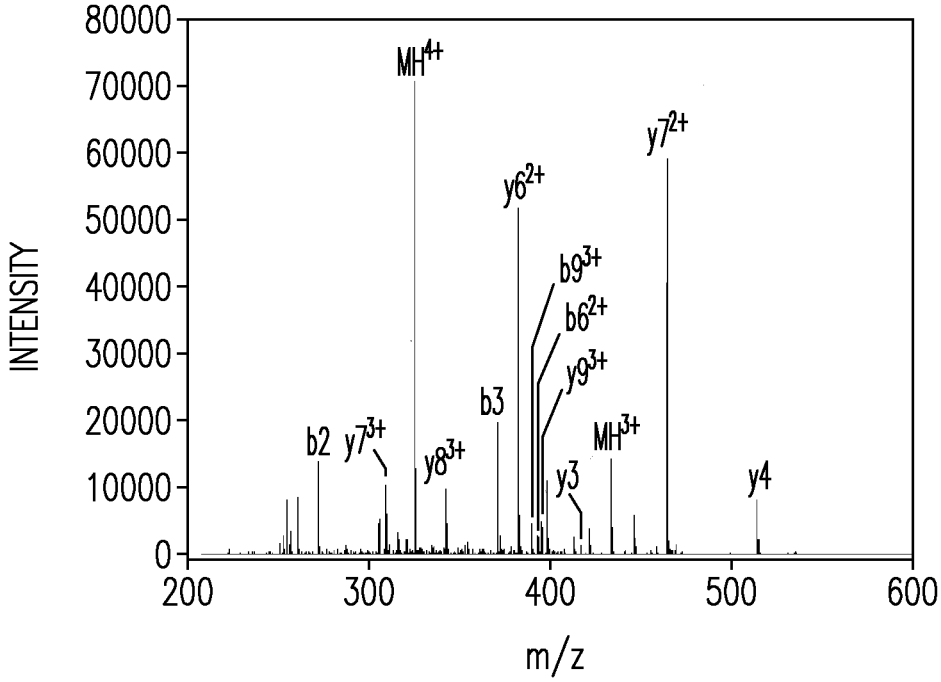
FIG. 8 is a mass spectrum of fragments obtained from $[\text{Angiotensin}]^{4+}$ ions (SEQ. ID. NO.: 3) in RF-heating mode.

FIG. 8 shows a typical fragmentation mass spectrum obtained by a process of the invention in RF-heating mode for $[\text{Angiotensin}]^{4+}$ precursor ions (SEQ. ID. NO. 3) by application of a DC-displacement voltage. The spectrum was generated by applying an exemplary DC-displacement voltage of 12.8 V, which is not limited. In the figure, the mass spectrum contains a rich distribution of major, high intensity fragments. Results further show a CID efficiency of ~90%.

Example

CID Mode

Collision Induced Dissociation (CID) in accordance with the invention has been demonstrated in the interface between an ion mobility spectrometer (IMS) and a time-of-flight mass spectrometer (TOF MS). To deconvolute the IMS-multiplexed CID-TOF MS raw data, informatics approaches effectively using information on the precursor and fragment drift profiles and mass measurement accuracy (MMA) were developed. It was shown that radial confinement of ion packets inside an RF-only segmented quadrupole operating at a pressure of ~200 mTorr and, having an axial DC-electric field minimizes ion losses due to defocusing and scattering, resulting in high abundance fragment ions which span a broad m/z range. Efficient dissociation at high pressure (~200 mTorr) and high ion collection efficiency inside the segmented quadrupole resulted in CID efficiencies of singly-charged ions comparable to those reported with triple quadrupole mass spectrometers. The modulation of the axial DC-electric field strength inside the segmented quadrupole can be used either to induce or to prevent multiplexed ion fragmentation. In addition, the axial electric field ensures ion transmission through the quadrupole at velocities which do not affect the quality of IMS separation. Importantly, both the precursor and fragment ions were acquired at good MMA (<20 ppm). The IMS-multiplexed CID TOF-MS approach was validated using a mixture of peptides and a tryptic digest of BSA. By aligning the precursor and fragment ion drift time profiles, an MMA of ±15 ppm for precursors and fragments, and the requirement of having greater than 3 unique fragments per unique precursor, 20 unique BSA tryptic peptides were confidently identified in a single IMS separation. On average, each peptide sequence was corroborated with 14 unique fragments. The peptide level false discovery rate of <1% was determined when matching IMS-multiplexed CID-TOFMS features against a decoy database composed of tryptic peptides of glycogen phosphorylase (PYGM) without use of liquid phase separation (e.g., LC). Incorporating IMS information for precursors and fragments and a high MMA for fragments decreased the FDR by a factor of >35 as compared to that obtained using the MMA information only. The developed IMS-multiplexed CID-TOF-MS approach provides high throughput, high confidence identifications of peptides from complex mixtures and, will be applied to identification of LC-IMS-TOF-MS features, which can only be detected due to separation in the IMS drift time domain.

CONCLUSIONS

Results demonstrate, that precursor ions activated inside an collision cell that combines an axial DC-electric field and RF-focusing produces abundant fragment ions which are radially confined within the RF-focusing field. In RF-heating mode, a dipolar DC-displacement pulse applied into one pair of the segmented quadrupole rods provides radial displacement of ions from the center ion channel axis. When radially displaced, ions gain energy from the RF-field, which increases the temperature of the ions and leads to dissociation of the ions. In collision-induced dissociation (CID) mode, precursor ions are collisionally activated in a locally increased axial DC field inside the focusing RF field. After collision and fragmentation, ions are collisionally cooled at high pressure and focused into the quadrupole axis, resulting in high transmission of fragmented products through the spectrometer interface to the mass spectrometer. In another variation of the approach, ion dissociation can be induced by a combination of collision-induced dissociation and RF-heating.

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

SEQUENCE LISTING

```
<160> NUMBER OF SEQ ID NOS: 7

<210> SEQ ID NO 1
<211> LENGTH: 16
<212> TYPE: PRT
<213> ORGANISM: Homo sapiens

<400> SEQUENCE: 1

Ala Asp Ser Gly Glu Gly Asp Phe Leu Ala Glu Gly Gly Gly Val Arg
1               5                   10                  15


<210> SEQ ID NO 2
<211> LENGTH: 13
<212> TYPE: PRT
<213> ORGANISM: Homo sapiens

<400> SEQUENCE: 2

Glu Leu Tyr Glu Asn Lys Pro Arg Arg Pro Tyr Ile Leu
1               5                   10


<210> SEQ ID NO 3
<211> LENGTH: 10
<212> TYPE: PRT
<213> ORGANISM: Homo sapiens

<400> SEQUENCE: 3

Asp Arg Val Tyr Ile His Pro Phe His Leu
1               5                   10


<210> SEQ ID NO 4
```

<211> LENGTH: 5
<212> TYPE: PRT
<213> ORGANISM: Homo sapiens

<400> SEQUENCE: 4

Tyr Gly Gly Phe Leu
1 5

<210> SEQ ID NO 5
<211> LENGTH: 5
<212> TYPE: PRT
<213> ORGANISM: Homo sapiens

<400> SEQUENCE: 5

Tyr Gly Gly Phe Met
1 5

<210> SEQ ID NO 6
<211> LENGTH: 9
<212> TYPE: PRT
<213> ORGANISM: Homo sapiens

<400> SEQUENCE: 6

Arg Pro Pro Gly Phe Ser Pro Phe Arg
1 5

<210> SEQ ID NO 7
<211> LENGTH: 607
<212> TYPE: PRT
<213> ORGANISM: Bos taurus

<400> SEQUENCE: 7

Met Lys Trp Val Thr Phe Ile Ser Leu Leu Leu Leu Phe Ser Ser Ala
1 5 10 15

Tyr Ser Arg Gly Val Phe Arg Arg Asp Thr His Lys Ser Glu Ile Ala
20 25 30

His Arg Phe Lys Asp Leu Gly Glu Glu His Phe Lys Gly Leu Val Leu
35 40 45

Ile Ala Phe Ser Gln Tyr Leu Gln Gln Cys Pro Phe Asp Glu His Val
50 55 60

Lys Leu Val Asn Glu Leu Thr Glu Phe Ala Lys Thr Cys Val Ala Asp
65 70 75 80

Glu Ser His Ala Gly Cys Glu Lys Ser Leu His Thr Leu Phe Gly Asp
85 90 95

Glu Leu Cys Lys Val Ala Ser Leu Arg Glu Thr Tyr Gly Asp Met Ala
100 105 110

Asp Cys Cys Glu Lys Gln Glu Pro Glu Arg Asn Glu Cys Phe Leu Ser
115 120 125

His Lys Asp Asp Ser Pro Asp Leu Pro Lys Leu Lys Pro Asp Pro Asn
130 135 140

Thr Leu Cys Asp Glu Phe Lys Ala Asp Glu Lys Lys Phe Trp Gly Lys
145 150 155 160

Tyr Leu Tyr Glu Ile Ala Arg Arg His Pro Tyr Phe Tyr Ala Pro Glu
165 170 175

Leu Leu Tyr Tyr Ala Asn Lys Tyr Asn Gly Val Phe Gln Glu Cys Cys
180 185 190

Gln Ala Glu Asp Lys Gly Ala Cys Leu Leu Pro Lys Ile Glu Thr Met
195 200 205

Arg Glu Lys Val Leu Ala Ser Ser Ala Arg Gln Arg Leu Arg Cys Ala
210 215 220

-continued

```
Ser Ile Gln Lys Phe Gly Glu Arg Ala Leu Lys Ala Trp Ser Val Ala
225                 230                 235                 240

Arg Leu Ser Gln Lys Phe Pro Lys Ala Glu Phe Val Glu Val Thr Lys
                245                 250                 255

Leu Val Thr Asp Leu Thr Lys Val His Lys Glu Cys Cys His Gly Asp
            260                 265                 270

Leu Leu Glu Cys Ala Asp Asp Arg Ala Asp Leu Ala Lys Tyr Ile Cys
        275                 280                 285

Asp Asn Gln Asp Thr Ile Ser Ser Lys Leu Lys Glu Cys Cys Asp Lys
    290                 295                 300

Pro Leu Leu Glu Lys Ser His Cys Ile Ala Glu Val Glu Lys Asp Ala
305                 310                 315                 320

Ile Pro Glu Asn Leu Pro Pro Leu Thr Ala Asp Phe Ala Glu Asp Lys
                325                 330                 335

Asp Val Cys Lys Asn Tyr Gln Glu Ala Lys Asp Ala Phe Leu Gly Ser
            340                 345                 350

Phe Leu Tyr Glu Tyr Ser Arg Arg His Pro Glu Tyr Ala Val Ser Val
        355                 360                 365

Leu Leu Arg Leu Ala Lys Glu Tyr Glu Ala Thr Leu Glu Glu Cys Cys
    370                 375                 380

Ala Lys Asp Asp Pro His Ala Cys Tyr Ser Thr Val Phe Asp Lys Leu
385                 390                 395                 400

Lys His Leu Val Asp Glu Pro Gln Asn Leu Ile Lys Gln Asn Cys Asp
                405                 410                 415

Gln Phe Glu Lys Leu Gly Glu Tyr Gly Phe Gln Asn Ala Leu Ile Val
            420                 425                 430

Arg Tyr Thr Arg Lys Val Pro Gln Val Ser Thr Pro Thr Leu Val Glu
        435                 440                 445

Val Ser Arg Ser Leu Gly Lys Val Gly Thr Arg Cys Cys Thr Lys Pro
    450                 455                 460

Glu Ser Glu Arg Met Pro Cys Thr Glu Asp Tyr Leu Ser Leu Ile Leu
465                 470                 475                 480

Asn Arg Leu Cys Val Leu His Glu Lys Thr Pro Val Ser Glu Lys Val
                485                 490                 495

Thr Lys Cys Cys Thr Glu Ser Leu Val Asn Arg Arg Pro Cys Phe Ser
            500                 505                 510

Ala Leu Thr Pro Asp Glu Thr Tyr Val Pro Lys Ala Phe Asp Glu Lys
        515                 520                 525

Leu Phe Thr Phe His Ala Asp Ile Cys Thr Leu Pro Asp Thr Glu Lys
    530                 535                 540

Gln Ile Lys Lys Gln Thr Ala Leu Val Glu Leu Leu Lys His Lys Pro
545                 550                 555                 560

Lys Ala Thr Glu Glu Gln Leu Lys Thr Val Met Glu Asn Phe Val Ala
                565                 570                 575

Phe Val Asp Lys Cys Cys Ala Ala Asp Asp Lys Glu Ala Cys Phe Ala
            580                 585                 590

Val Glu Gly Pro Lys Leu Val Val Ser Thr Gln Thr Ala Leu Ala
        595                 600                 605
```

We claim:

1. An IMS-TOF-MS system, characterized by:

a collision cell comprising an ion channel that defines an axis traversed by precursor ions in a buffer gas at a pressure greater than 20 mTorr, said collision cell includes a substantially orthogonal RF-focusing field and a locally increased axial DC-field centered within a preselected portion along said axis inside said collision cell that in operation yields a plurality of structure-identifying fragment ions inside said ion channel.

2. The system of claim 1, wherein said DC-field provides collision between said precursor ions and said buffer gas that provides fragmentation of said precursor ions inside said ion channel that yields said plurality of structurally rich structure-identifying fragment ions.

3. The system of claim 1, where said locally increased axial DC-field is centered between 2 segments.

4. The system of claim 1, wherein said ion channel is defined by a preselected number (N) of circumvolving elongated members, where (N) is an even-numbered integer greater than or equal to 2.

5. The system of claim 4, wherein said elongated members each comprise at least two operably coupled linear segments each delivering a preselected potential of like or different kind.

6. The system of claim 5, wherein said at least two linear segments are each insulated from another of said at least two segments by a resistor chain or network that controls said axial DC-field applied to said elongate members.

7. The system of claim 1, further including one or more segmented vanes operably decoupled from said elongated members that deliver an axial DC-field and a preselected dipolar DC-field orthogonal to said ion channel axis.

8. The system of claim 7, wherein the potential distribution of said dipolar DC-field is symmetric about said ion channel axis.

9. The system of claim 7, wherein the potential distribution of said dipolar DC-field is asymmetric about said ion channel axis.

10. The system of claim 7, wherein said dipolar DC field is a DC pulse that provides radial displacement of said ions from said axis inside said ion channel synchronously with an IMS gate pulse.

11. The system of claim 7, wherein said dipolar DC field provided by said vanes is a DC field superimposed over said axial DC field that provides precursor fragmentation due to both axial acceleration into said buffer gas and RF-heating.

12. The system of claim 1, wherein said fragment ions are radially confined within said focusing RF-field.

13. The system of claim 1, wherein said collision cell is coupled at the interface between a drift tube IMS stage and a TOF-MS instrument stage.

14. A method for enhanced fragmentation of ions, characterized by the steps of:

applying an axial DC-field and a substantially orthogonal RF-focusing field along an axis defined through an ion channel of a collision cell;

flowing a plurality of precursor ions at a pressure greater than 20 mTorr through said ion channel filled with a buffer gas; and fragmenting said precursor ions by collision with said buffer gas in said RF-focusing field, generating a plurality of structure-identifying fragment ions inside said ion channel.

15. The method of claim 14, wherein the step of applying includes applying an increased local DC-field inside said collision cell to accelerate said precursor ions along said axis defined through said ion channel.

16. The method of claim 14, wherein the step of fragmenting includes accelerating said precursor ions axially in said DC-electric field to increase the impact velocity of said ions with said buffer gas along said axis inside said ion channel within said RF-focusing field.

17. The method of claim 14, wherein the step of fragmenting includes collisionally cooling said fragment ions inside said ion channel to maximize the distribution and quantity of said structure-identifying fragment ions inside said ion channel.

18. The method of claim 14, wherein the step of fragmenting includes use of a collision voltage in the range from about 10 volts to about 100 volts.

19. The method of claim 14, further including the step of radially confining said fragment ions within said RF-focusing field for re-collimation of same.

20. The method of claim 14, further including the step of accelerating said fragment ions along said axis of said ion channel using said axial DC-field to maintain high resolution obtained from a coupled drift tube IMS stage.

21. The method of claim 14, wherein the CID efficiency ($E_{CID}$) is in the range from about 60% to about 90%.

22. The method of claim 14, wherein the step of fragmenting includes radially displacing said precursor ions from said axis to induce RF-heating that activates same.

23. The method of claim 22, further including the step of radially confining said ion fragments within said focusing RF-field inside said collision cell to minimize ion losses.

24. The method of claim 23, further including the step of focusing said radially displaced fragment ions back along said axis using said axial DC field to maximize transmission of said ions to a subsequent instrument stage.

25. The method of claim 24, further including the step of transmitting said fragment ions on-axis from said collision cell to a subsequent instrument stage.

26. A method for enhanced dissociation of precursor ions, characterized by the steps of:

applying an axial DC-electric field generating an axial DC displacement gradient along a center longitudinal axis of a segmented N-pole device that accelerates a beam of charged precursor ions introduced inside said segmented N-pole device axially along said center longitudinal axis in said axial DC-electric field;

activating said precursor ions by applying a DC-displacement field, radially displacing same from along said center longitudinal axis; and fragmenting said precursor ions by collision with neutral gas molecules in a stream of gas producing ion fragments thereof.

* * * * *